US011607037B2

(12) United States Patent
Baez

(10) Patent No.: US 11,607,037 B2
(45) Date of Patent: Mar. 21, 2023

(54) SHELVING SYSTEM FOR RESISTING APPLIED SHEAR FORCES AND METHOD FOR FORMING THE SAME

(71) Applicant: Cambro Manufacturing Company, Huntington Beach, CA (US)

(72) Inventor: Jorge Baez, Lake Forest, CA (US)

(73) Assignee: Cambro Manufacturing Company, Huntington Beach, CA (US)

( * ) Notice: Subject to any disclaimer, the term of this patent is extended or adjusted under 35 U.S.C. 154(b) by 0 days.

(21) Appl. No.: 17/397,043

(22) Filed: Aug. 9, 2021

(65) Prior Publication Data

US 2021/0361066 A1 Nov. 25, 2021

Related U.S. Application Data

(63) Continuation-in-part of application No. 16/722,695, filed on Dec. 20, 2019, now abandoned.

(51) Int. Cl.
*A47B 57/54* (2006.01)
*A47B 47/04* (2006.01)

(52) U.S. Cl.
CPC ..... *A47B 57/545* (2013.01); *A47B 47/045* (2013.01)

(58) Field of Classification Search
CPC . A47B 57/545; A47B 47/045; A47B 47/0083; A47B 47/0058; A47B 47/0016; A47B 47/0008; A47B 57/10; A47B 57/08; A47B 57/00; A47B 57/045; A47B 57/265
See application file for complete search history.

(56) References Cited

U.S. PATENT DOCUMENTS 3,972,638 A * 8/1976 Vivoli ..... E04B 2/76 403/174
4,627,543 A * 12/1986 Nicely ..... A47B 57/265 211/208
4,852,501 A * 8/1989 Olson ..... A47B 57/265 108/107
5,174,200 A * 12/1992 Jeandel ..... A47B 57/482 108/193
5,695,081 A 12/1997 Alkalay
5,779,070 A 7/1998 Dickinson
5,922,195 A 7/1999 Pastore
6,044,988 A * 4/2000 Yang ..... A47B 57/265 211/187

(Continued)

*Primary Examiner* — Devin K Barnett
(74) *Attorney, Agent, or Firm* — Marcus C. Dawes

(57) ABSTRACT

A shelving system formed by a plurality of vertical posts and horizontal traverses held together through frictional engagement. Disposed between each lateral pair of posts is at least one traverse which includes a male frictional engagement member configured to engage with a removable female frictional engagement member disposed on each post. The post and traverse engage with each other so as to create a proportional or supportive reaction force in response to any shear force applied to the shelving system. Each of the female frictional engagement members has a tapered edge which forms a closely fitted coupling between the post and each traverse. Each of the female frictional engagement members may be selectively disposed in one of a plurality of positions along the height of each vertical post. The shelving system further includes top and bottom connectors, both of which also frictionally engage with the vertical posts.

14 Claims, 36 Drawing Sheets

(56) References Cited

U.S. PATENT DOCUMENTS

| | | | | |
|---|---|---|---|---|
| 6,253,933 | B1 | 7/2001 | Yang | |
| D651,433 | S * | 1/2012 | Le | D6/702 |
| 8,376,156 | B2 | 2/2013 | Jarvis et al. | |
| 8,376,157 | B2 | 2/2013 | Jarvis et al. | |
| 8,627,966 | B2 | 1/2014 | Jarvis et al. | |
| 10,960,910 | B1 * | 3/2021 | Garcia | B62B 3/02 |
| D937,668 | S * | 12/2021 | Baez | D8/382 |
| 11,197,542 | B2 * | 12/2021 | Haimoff | A47B 87/007 |
| 2002/0113346 | A1 | 8/2002 | Constantinescu | |
| 2003/0131767 | A1 | 7/2003 | Chen | |
| 2004/0175563 | A1 | 9/2004 | Okerson | |
| 2008/0116156 | A1 * | 5/2008 | Park | A47B 87/0207 211/186 |
| 2010/0089852 | A1 * | 4/2010 | Wang | A47F 5/13 211/153 |
| 2010/0155352 | A1 * | 6/2010 | Hsieh | A47B 57/265 211/183 |
| 2011/0253658 | A1 * | 10/2011 | Jarvis | A47B 47/045 29/525.08 |
| 2011/0253659 | A1 * | 10/2011 | Jarvis | A47B 57/545 29/525.09 |
| 2012/0031864 | A1 * | 2/2012 | Wasson | A47B 96/021 211/134 |
| 2013/0098857 | A1 * | 4/2013 | Jarvis | A47B 47/045 211/182 |
| 2021/0071700 | A1 * | 3/2021 | Zanette | F16B 7/02 |
| 2021/0186211 | A1 * | 6/2021 | Baez | A47B 57/545 |
| 2022/0061526 | A1 * | 3/2022 | Le | A47B 88/417 |

* cited by examiner

SHELVING SYSTEM FOR RESISTING APPLIED SHEAR FORCES AND METHOD FOR FORMING THE SAME

BACKGROUND

Field of the Technology

The invention relates to the field of shelving and shelving systems, particularly to shelving units which are easily assembled from a plurality of components without comprising the structural integrity of the shelving unit.

Description of the Prior Art

Utility or commercial shelving units or shelving systems comprised of different types of materials have long been used in the art. Some of the materials commonly used include wood, metal, plastic or plastic composites. Many of these prior art shelving systems have a plurality of shelves which can either be fixed at certain predetermined heights or may be adjustable to one of a series of available heights using an adjustable coupling means such as clamps, buckles, or sliding and locking mounts. Some shelving systems also include drawers or cabinets as well.

While many of the prior art designs are not without their respective merits, several limitations found in the prior art have become apparent. The first and most crucial of these limitations is the ratio of the load that may be supported by the shelving system to the weight of the shelving system itself. For example, a shelving system that is infused with concrete or reinforced steel may be able to support a relatively large load, however the weight that is added to the shelving system makes the entire system cumbersome and difficult to reconfigure or adjust to the specific needs of any specific user. On the other hand, if a shelving system is too light, the load it can support may be severely restricted thus limiting the scope of use of the shelving system.

Additionally, for shelving systems with shelves that may be adjusted to a user determined height, the means for coupling the shelves to their support posts can be overly complicated or inconvenient. Adjustable coupling means that are too complicated are more prone to malfunction and can add additional unnecessary weight to the shelving system. Inconvenient coupling means may similarly be difficult to use or require at least two people to operate.

Relatedly, many shelving units or shelving systems are manufactured in multiple parts which are delivered to the consumer who must then assemble the shelving unit before using it. Cumbersome or overly complicated coupling means not only make the shelving system more difficult or inconvenient to use, but the more complicated the means for assembling the shelf unit, the more likely that the user will improperly construct the shelf unit which could therefore lead to a structural failure. For example, if the user improperly or incompletely joins a traverse of a shelf to a vertical post and then places a weight on the shelf, the odds of the traverse decoupling from the post or otherwise failing is dramatically increased. As a result therefore, the maximum weight capacity of the shelving system is dramatically reduced, if not completely nullified. Additionally, when a shear force or stress is applied to the shelving system, such as when a user or other object bumps into or collides with the system, the applied force can cause the connection points of the shelving system to weaken or even fail completely.

What is needed is a shelving system that is strong enough to support large load distributions and yet still capable of resisting any shear forces which are applied to the shelving system without comprising the overall structural integrity of the shelving system itself. Additionally, the shelving system should be easily assembled from a plurality of parts in such a manner so as to prevent a user from incorrectly constructing the shelving system and perhaps compromising its structural integrity in the process.

BRIEF SUMMARY

The current invention provides a shelving system which includes a plurality of posts and a plurality of connectors, where each post connector is configured to connect to at least two of the posts. The shelving system also includes a plurality of traverses, each traverse being configured to connect to at least two of the posts. The shelving system further includes a plurality of removable female brackets, each removable female bracket including at least one tapered edge. Each of the plurality of traverses in turn include a male bracket that is disposed on each of a pair of ends of the traverse, where each male bracket is specifically configured to apply a force to at least one female bracket which is supportive of a weight applied to the shelving system.

In one embodiment, each of the male brackets is configured to frictionally engage with the tapered edge of a corresponding female bracket.

In another embodiment, each of the removable female brackets has a tab which is configured to be inserted into one of a plurality of notches that are defined along a height of each of the posts.

In yet another embodiment, each of the female brackets have a base with a pocket defined therein, the pocket being specifically configured to accommodate a corresponding one of the male brackets.

In another embodiment, the shelving also includes a plurality of inserts, wherein each of the inserts includes a hollow interior which is configured to accommodate one of the posts therethrough, a front wall having a frontal opening which bifurcates the front wall into two equal halves, and a pair of catches, wherein at least one of the catches is disposed on one of the two halves of the bifurcated front wall. In this embodiment, each of the connectors has a female key defined in each of its lateral ends, the female key being specifically configured to accommodate the pair of catches that are disposed on the insert. The pair of catches are themselves configured to apply a reaction force in any direction to at least one of the connectors in response to a shear force applied to the shelving system. Specifically, the pair of catches are configured to apply the reaction force to an inside surface of the female key that is defined in each lateral end of each of the connectors when the pair of catches are inserted into the female key. Also in this embodiment, the hollow interior of each insert may include an internal volume which is capable of accommodating a horizontal cross sectional shape of a corresponding one of the posts.

In another embodiment, the male bracket disposed on each end of each traverse includes a hook that is configured to accommodate a portion of at least one of the posts therein.

The invention further provides a system for forming a shelf unit. The system includes a plurality of posts, a plurality of removable top connectors which each include at least two end caps, and a plurality of removable bottom connectors which include at least two collars. The system also includes a plurality of traverses which each include at least two male brackets and a plurality of removable inserts that are each configured to connect to either one of the top connectors or one of the bottom connectors. A plurality of removable female brackets are also provided which are each configured to connect one of the traverses to one of the posts. Specifically, each of the plurality of inserts is configured to apply a reaction force in any direction to either one of the top connectors or one of the bottom connectors in response to a shear force applied to the shelf unit. Additionally, the male brackets that are disposed on each of the traverses are configured to apply a force to one of the female brackets that is supportive of a weight applied to the shelving system.

In one embodiment, the system also includes a female key that is defined within a surface of each of the end caps and each of the collars that are disposed on each of the top connectors and each of the bottom connectors, respectively. In this embodiment, a pair of catches may be disposed on each of the inserts which are configured to be inserted into the female key defined in either one of the plurality of end caps or one of the plurality of collars.

In another embodiment, each of the plurality of female brackets have at least one tapered edge that is configured to interact with one of the two male brackets that are disposed on each of the traverses.

In a further embodiment, each of the plurality of female brackets have a tab which is configured to be inserted into one of a plurality of notches that are defined along a first edge of at least one of the posts. Here, each of the male brackets also include a hook that is configured to accommodate a second edge of at least one of the posts, where the second edge is disposed on an opposing side of the post relative to the first edge of the post.

The invention further provides a method for forming a shelving system that is resistant to applied shear forces. The method includes coupling at least one top post connector to at least two of a plurality of posts, coupling at least one bottom connector to at least two of the plurality of posts, and coupling at least one traverse to at least two of the plurality of posts. Coupling the traverse to the posts specifically includes disposing a female bracket into one of a plurality of notches that is defined along a height of each of the posts, the female bracket itself having at least one tapered edge. Next, a male bracket disposed on each end of the traverse is pressed over the female bracket that is disposed on each of the posts, wherein the tapered edge of the female bracket makes surface contact with the male bracket.

In one embodiment, pressing the male bracket disposed on each end of the traverse over the female bracket disposed on each of the posts specifically includes squeezing the female bracket tighter against each of the posts as contact between the at tapered edge of the female bracket and the male bracket increases.

In another embodiment, coupling the top connector to the two posts specifically includes disposing an insert onto each of the posts, inserting a top portion of each of the posts and the insert into a corresponding pair of end caps disposed on either end of the top connector, and then coupling the end cap disposed on either end of the top post connector to the insert disposed on each of the posts. Here, coupling the end cap disposed on either end of the top post connector to the insert disposed on each of the posts may further include inserting at least two catches that are disposed on the insert into a female key that is defined in a surface of each of the end caps.

In yet another embodiment, coupling the bottom connector to the posts specifically includes disposing an insert onto each of the posts, inserting the posts and the insert disposed thereon through a corresponding pair of collars that are disposed on either end of the bottom connector, and then coupling the collar disposed on either end of the bottom post connector to the insert that is disposed on each of the posts. Here, coupling the collar that is disposed on either end of the bottom post connector to the insert that is disposed on each of the posts specifically includes inserting at least two catches that are disposed on the insert into a female key that is defined in a surface of each of the collars.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

Figure 1A:
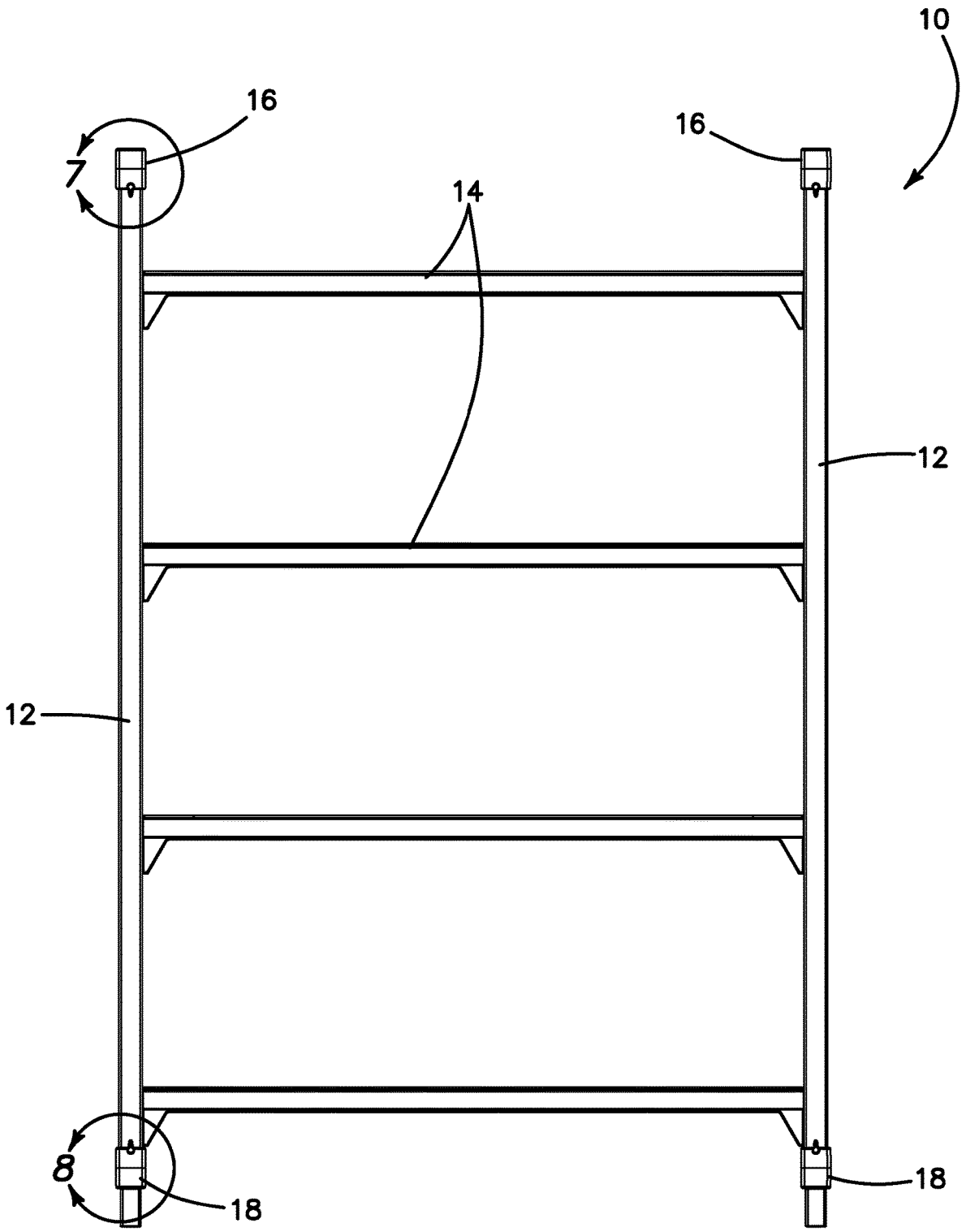
FIG. 1A is a planar view of a longitudinal side of the shelving system of the current invention.
Figure 1B:
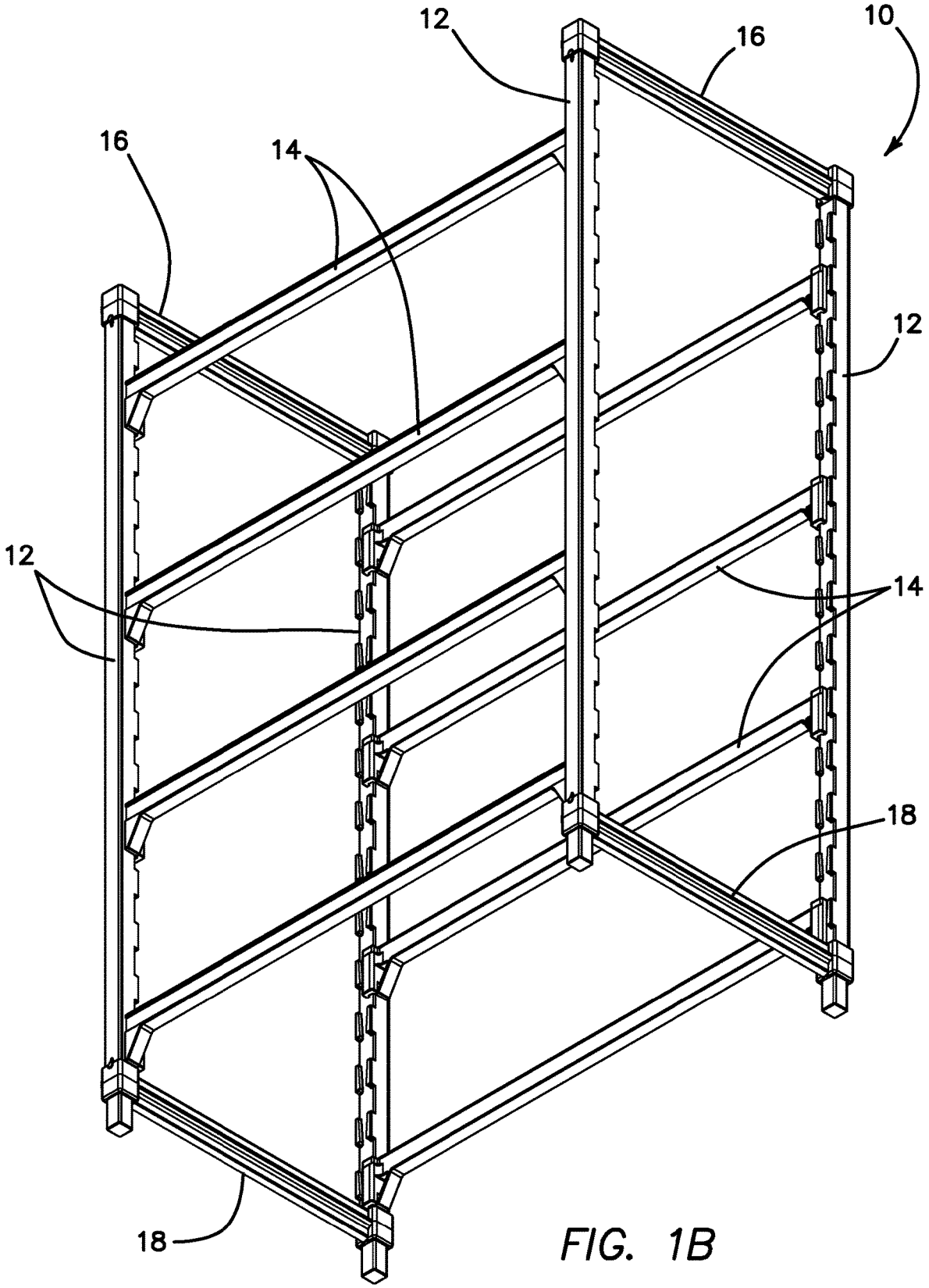
FIG. 1B is a bottom perspective view of the shelving system seen in FIG. 1A.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

A first embodiment of the current invention is seen in FIGS. 1A-1E where the shelving system is generally denoted by reference numeral 10. The shelving system primarily comprises a plurality of vertical posts 12 arranged in a substantially rectangular pattern. One vertical post 12 is preferably disposed at each respective corner of the rectangle. While there are four vertical posts 12 shown in FIGS. 1A-1E, it is important to note that any number of vertical posts may be used in any number of configuration such as squares, circles, semi-circles and the like without departing from the original spirit and scope of the invention.

Figure 1C:
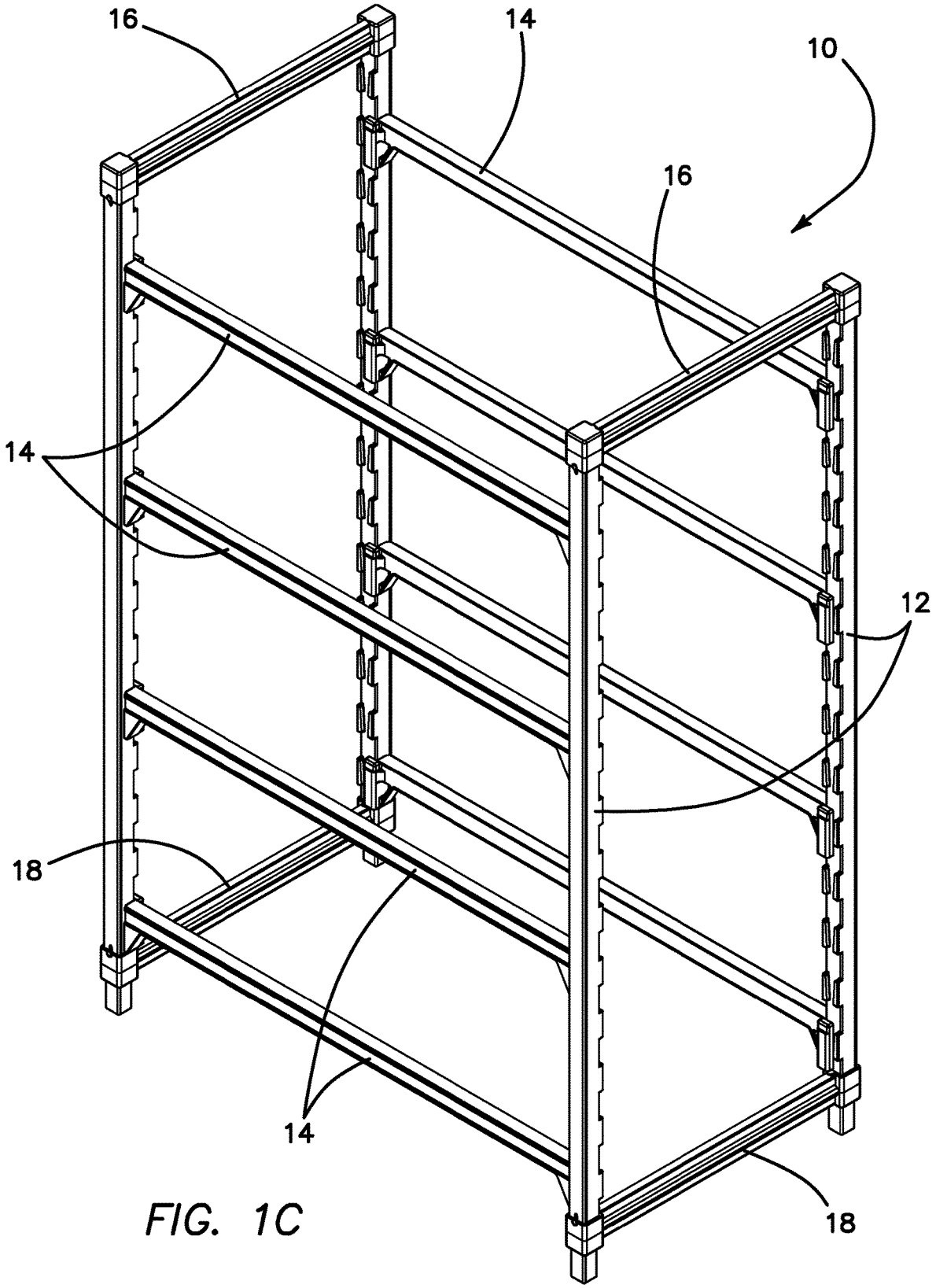
FIG. 1C is a top perspective view of the shelving system seen in FIG. 1A.
Figure 1D:
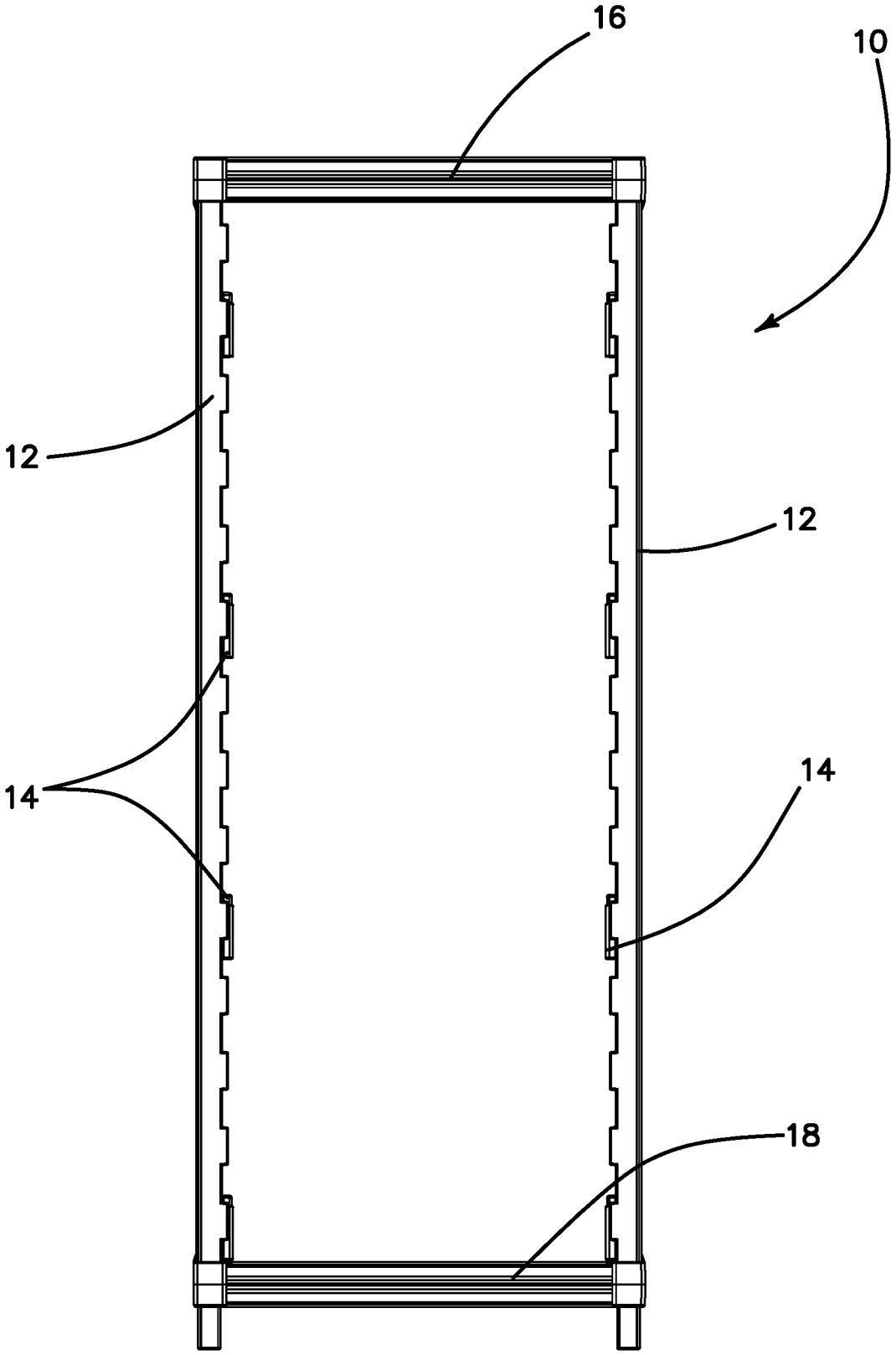
FIG. 1D is planar view of a lateral side of the shelving system seen in FIG. 1A.
Figure 1E:
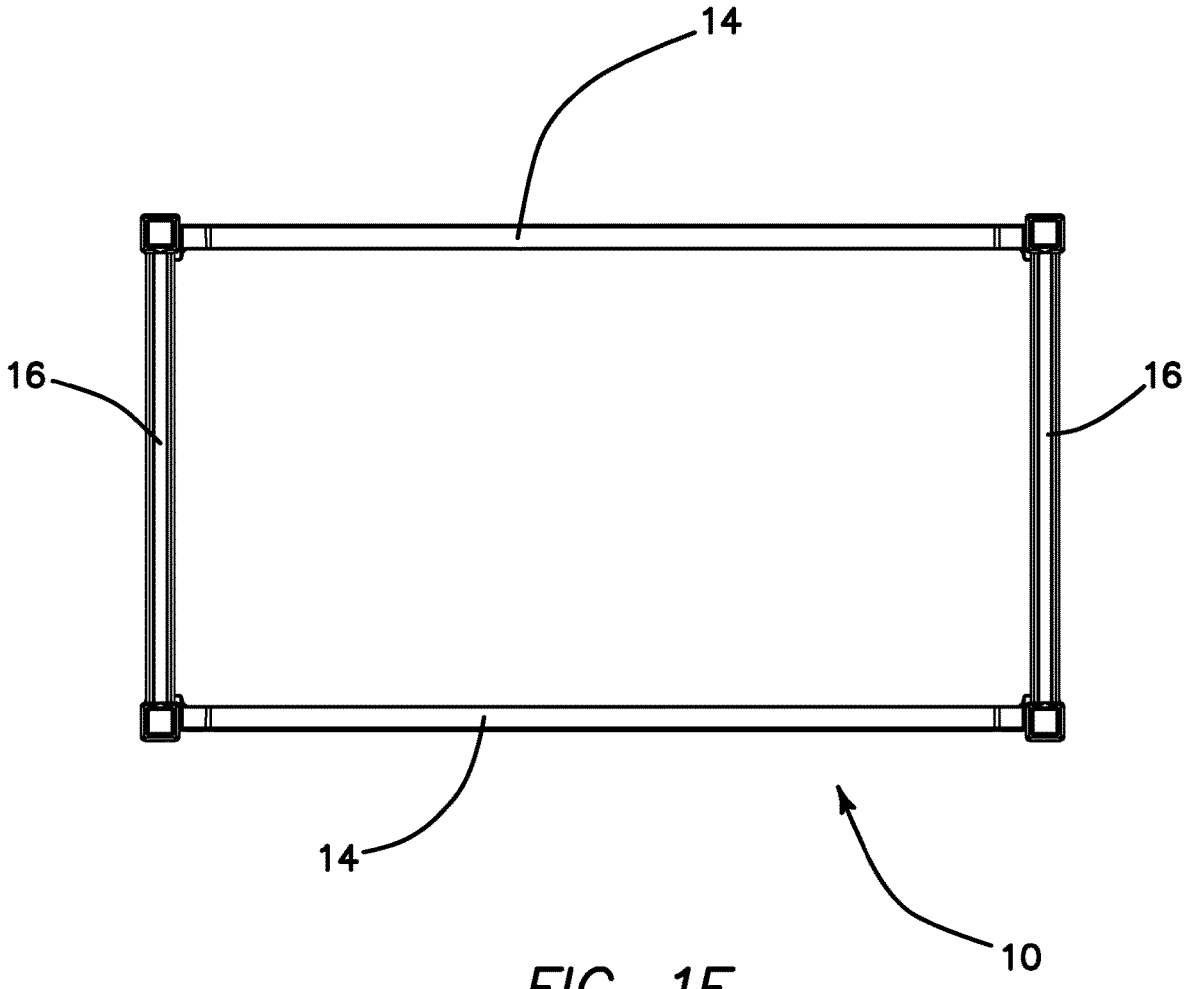
FIG. 1E is top down view of the shelving system seen in FIG. 1A.

Disposed laterally between the plurality of vertical posts 12 are a plurality of horizontal traverses 14. In the embodiment best seen in FIGS. 1B and 1C, the horizontal traverses 14 are paired up in parallel groups of two and are coupled to vertical posts 12 at either end of each traverse 14. Each parallel pair of traverses 14 thereby forms a support structure or a frame for a shelf. Specifically, each parallel pair of traverse 14 may accommodate a plurality of removable shelf plates, storage containers or modules, or any other adjustable, removable, or configurable components related to a shelving system now known or later devised. It should also be noted that fewer or additional traverses 14 other than what is explicitly shown in FIGS. 1A-1E may be used without departing from the original spirit and scope of the invention. For example, FIG. 1C shows four pairs of parallel traverses 14 thereby providing at least four frames or supports for four different shelving areas, however additional pairs of traverses 14 may be present thereby providing more options for the user to dispose shelving plates or other shelving system related components at different levels or heights within the shelving system 10.

The vertical posts 12 and horizontal traverses 14 of the shelving system 10 are made by a pultrusion process comprising the following steps of providing a supply of fiberglass ravings, guiding fibers from the fiberglass ravings through a resin impregnator, saturating the fibers with resin from the resin impregnator, pulling the saturated fibers through a forming die, forming the fibers to a predetermined shape to form a pultruded component, and cutting the formed pultruded traverse or post to a predetermined length. Specifically, both the primary horizontal traverses 14 and the primary vertical posts 12 are comprised of plastic or plastic composites and are fabricated by the known process of pultrusion.

The process of pultrusion in general includes a plurality of strands of fiberglass or other suitable material being extruded from a plurality of ravings disposed on a rack by a plurality of pulleys or other suitable means. The strands of fiberglass are brought together with other materials such as mats and are placed in a resin bath or are otherwise impregnated with resin and other substances that bind the roving strands together in a resin impregnator. The resin may either be liquid or powder based depending on the type of fiberglass material being supplied by the rovings, and may include a mixture of one or more thermosetting or thermoplastic resins. Various types of filament winding may be added if desired to the resin infused strands by an in-line winder. Adding a filament winding increases the bi-axial strength of the pultruded component. The resin infused strands are then mechanically pulled by a set of roving pullers through a set of performers which help the fiberglass rovings obtain an initial rough shape before being pulled through a curring die which forms the fiberglass to a permanent predetermined shape. After being pulled, heated, or cured, a saw then cuts the pultruded component down to a desired length or plurality of lengths.

In the preferred embodiment of the current invention, the horizontal traverses 14 and vertical posts 12 are comprised of a mixture of 70% to 80% glass and 20% to 30% resin. The fiberglass being fed from the rovings is a continuous filament of 2025 Fiver glass. As the fiberglass enters the resin impregnator 176, a resin comprising 50% BAYDUR PUL2500 (Polymeric Diphenyimethane Diisocyanate (pMDI)), 47.32% BAYDURE PUL2500 (Polyol System), 2.07% mold release (AXEL INT-1948MCH), and 0.25% color load (REBUS Code 70165) is impregnated onto the fiberglass. After each of the components have been properly cured, molded, and cut, the resulting product is an extremely strong and durable structural element for the shelving system 10 that is still lightweight enough to be easily carried or otherwise manipulated. It is to be expressly understood however that other similar types of fiberglass or resins may be used in differing proportions from what is listed here without departing from the original spirit and scope of the invention.

Coupled to a top portion of at least two adjacently disposed vertical posts 12 is a top post connector 16. Similarly, coupled to a bottom portion of at least two adjacently disposed vertical posts 12 is a bottom post connector 18. Both the top post connectors 16 and the bottom post connectors 18 are orientated perpendicularly relative to the plurality of traverses 14 as best seen in the top down view of the shelving system 10 of FIG. 1E. Additionally, both the top post connectors 16 and bottom post connectors 18 are preferably comprised of injection molded plastic or plastic composites.

Figure 2A:
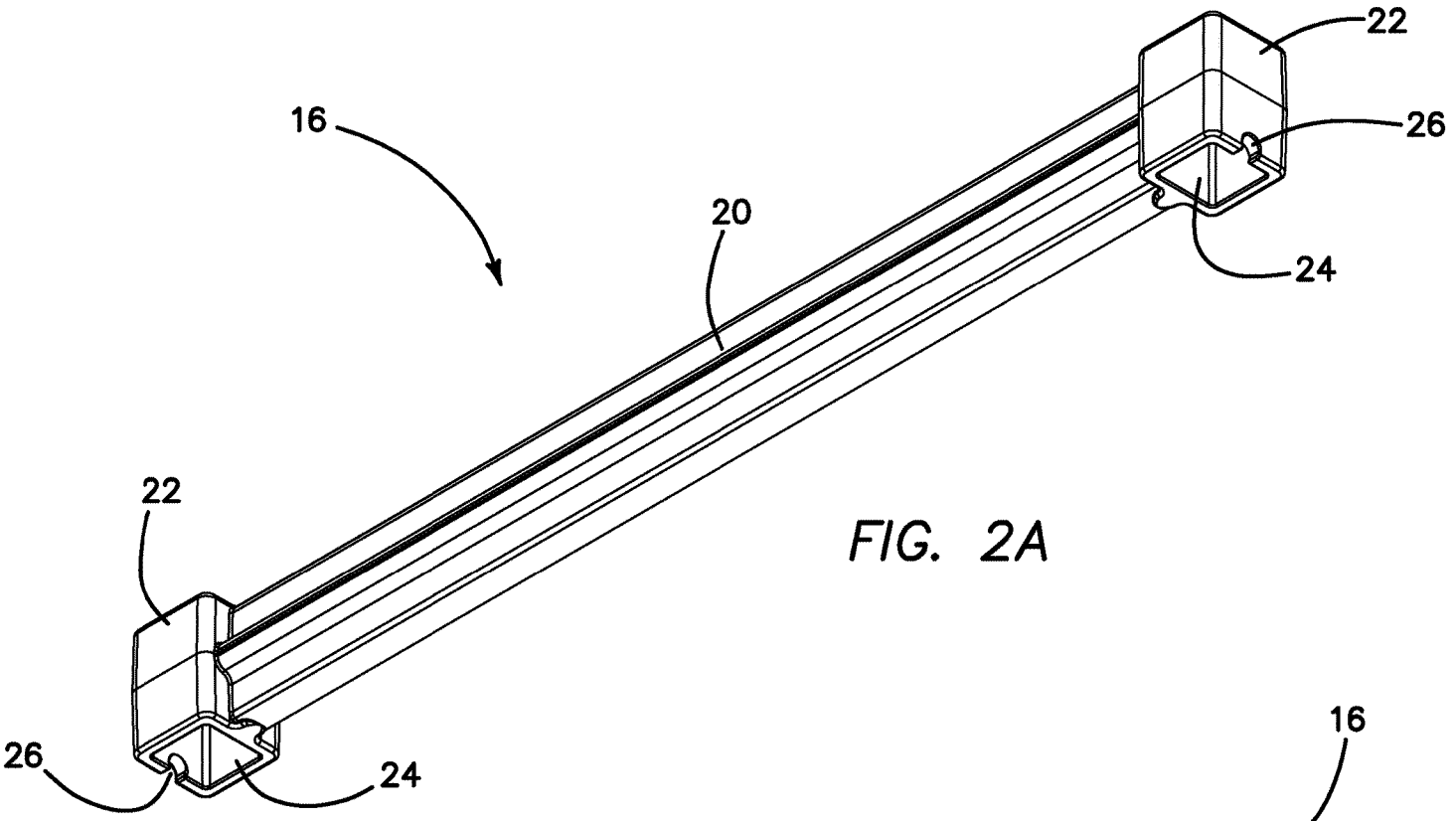
FIG. 2A is a bottom perspective view of a top post connector included within the shelving system of the current invention.
Figure 2B:
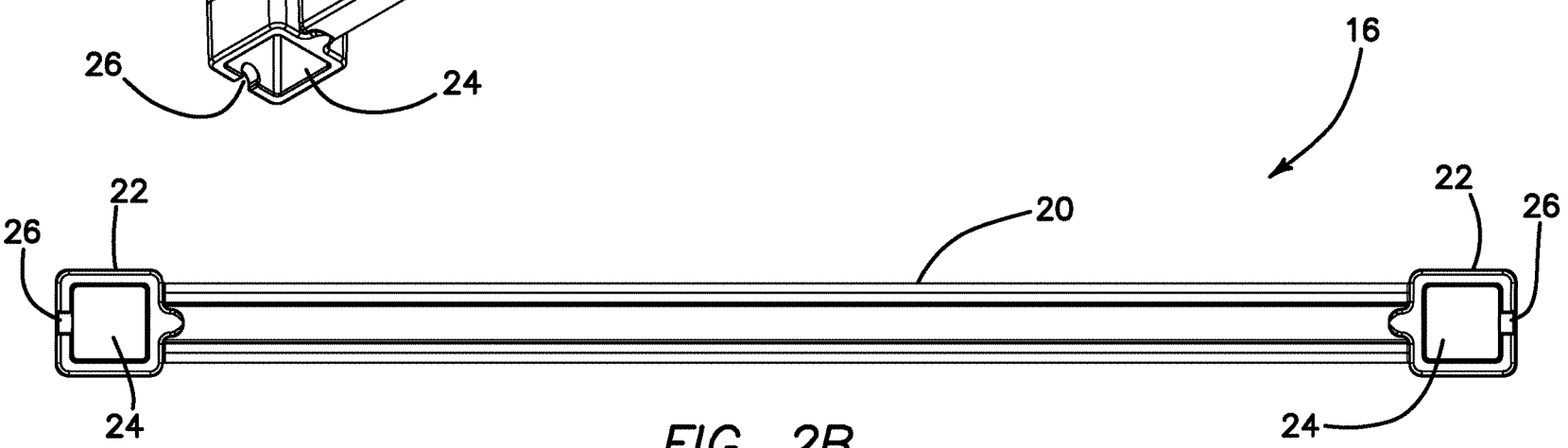
FIG. 2B is a bottom view of the top post connector seen in FIG. 2A.
Figure 2C:
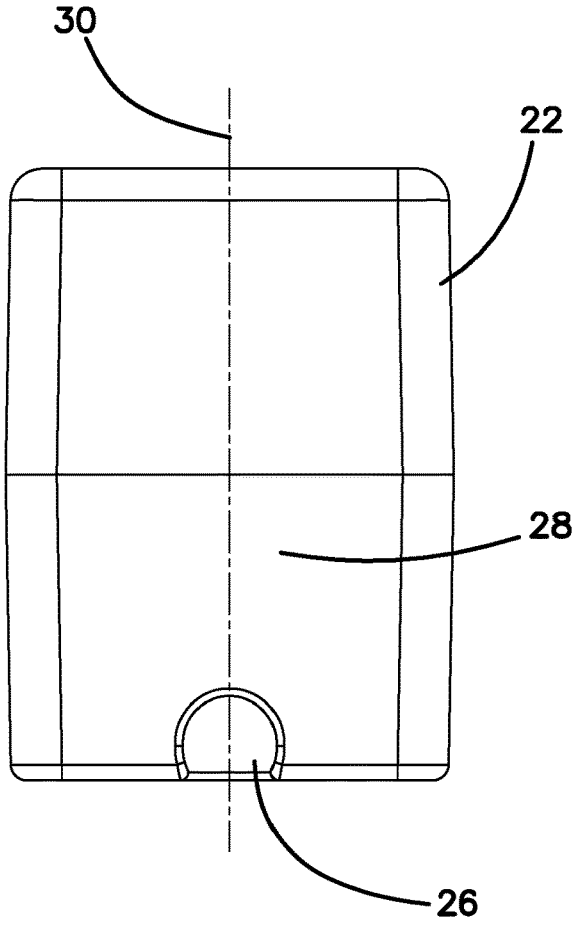
FIG. 2C is a magnified frontal view of a post cap coupled to the top post connector seen in FIG. 2A.

Greater detail of the top post connectors 16 may be seen in FIGS. 2A-2C. Each top post connector 16 comprises a substantially longitudinal crosspiece 20 with a substantially cuboidal post cap 22 disposed on either lateral end of the crosspiece 20. Each post cap 22 comprises a post aperture 24 which is defined in its bottom surface. The post cap 22 forms a shell or is otherwise hollow so that a top portion or tip of a vertical post 12 may be accommodated or nested therein by being disposed or inserted into the internal volume of the post cap 22 through the post aperture 24 as is detailed further below.

Figure 6A:
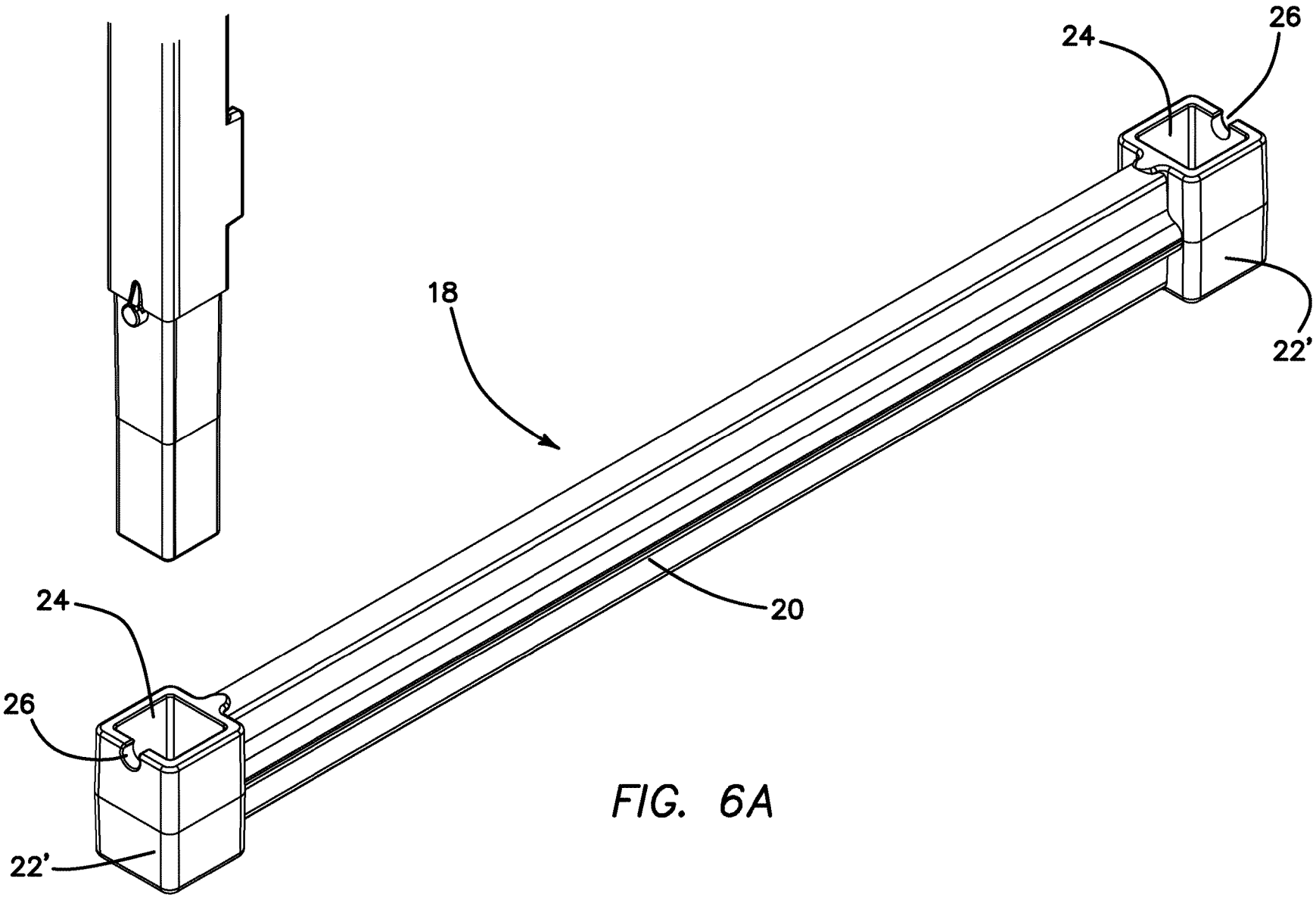
FIG. 6A is a top perspective view of the bottom post connector including within the shelving system of the current invention.
Figure 6B:
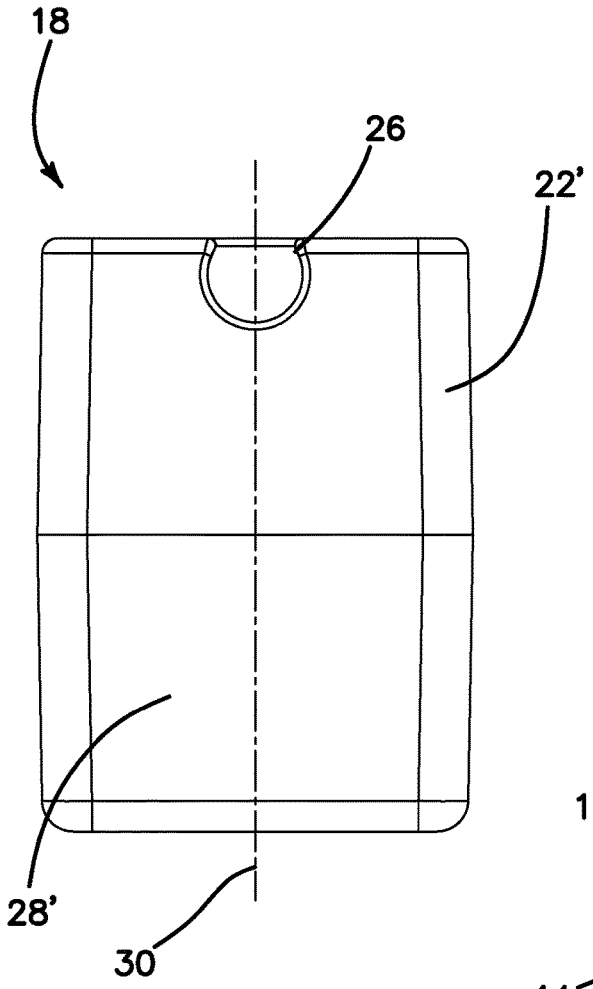
FIG. 6B is a magnified frontal view of a post sleeve coupled to the bottom post connector seen in FIG. 6A.

In turn, greater detail of the bottom post connectors 18 may be seen in FIGS. 6A and 6B. Like the top post connector 16 discussed above, each bottom post connector 18 comprises a substantially longitudinal crosspiece 20 with a substantially cuboidal post sleeve 22' disposed on either lateral end of the crosspiece 20. Each post sleeve 22' comprises a post aperture 24 which is defined in both its top and bottom surface. The post sleeve 22' forms a shell or is otherwise hollow so that the bottom portion of the vertical post 12 may be accommodated or disposed therein by being inserted into the internal volume of the post sleeve 22' through the post aperture 24 as is detailed further below.

Each post cap 22 and post sleeve 22' comprises a cutout or female frictional engagement member 26 defined in at least one surface of the post cap 22 or post sleeve 22'. Specifically, as best seen in the bottom view of the top post connector 16 of FIG. 2B and the perspective view of the bottom post connector 18 of FIG. 6A, the female frictional engagement member 26 is defined completely through at least one edge or surface of the post cap 22 or the post sleeve 22' so as to form an asymmetrical bottom or top footprint, respectively. FIGS. 2C and 6B further specify that the female frictional engagement member 26 is defined at or approximate to the bottom of a front surface 28 of the post cap 22 and at the top of a front surface 28' of the post sleeve 22'. Additionally, the female frictional engagement member 26 is substantially centrally or symmetrically defined along a vertical axis 30 of the front surface 28 of the post cap 22 and of the front surface 28' of the post sleeve 22', respectively.

The female frictional engagement member 26 is seen in FIGS. 2C and 6B as being substantially circular or semi-circular in shape, however it is to be expressly understood that other shapes, sizes, or configurations may be used without departing from the original spirit and scope of the invention. For example, the female frictional engagement member 26 may comprise any shape which is capable or configured to frictionally engage another component inserted into it over a majority of its inner surface as defined within the respective front surfaces 28, 28' of the post cap 22 and post sleeve 22'. Such shapes or configurations include but are not limited to triangular, rectangular or parallelepiped, pentagonal, hexagonal, or octagonal. Additionally, while the female frictional engagement member 26 is seen in FIGS. 2B, 2C, and 6B as a hole or aperture defined through the front surface 28, 28', it is to be expressly understood that the female frictional engagement member 26 may comprise an additional surface or contact point beyond what is provided by the edge or thickness of the front surface 28, 28' itself. For example, the female frictional engagement member 26 may comprise a hood, ridge, or other projection or extension which extends out in a perpendicular direction relative to the vertical orientated front surface 28 so that a contact point or frictional surface is formed other than at the position or vertical plane shared by the front surface 28, 28' itself.

Figure 3:
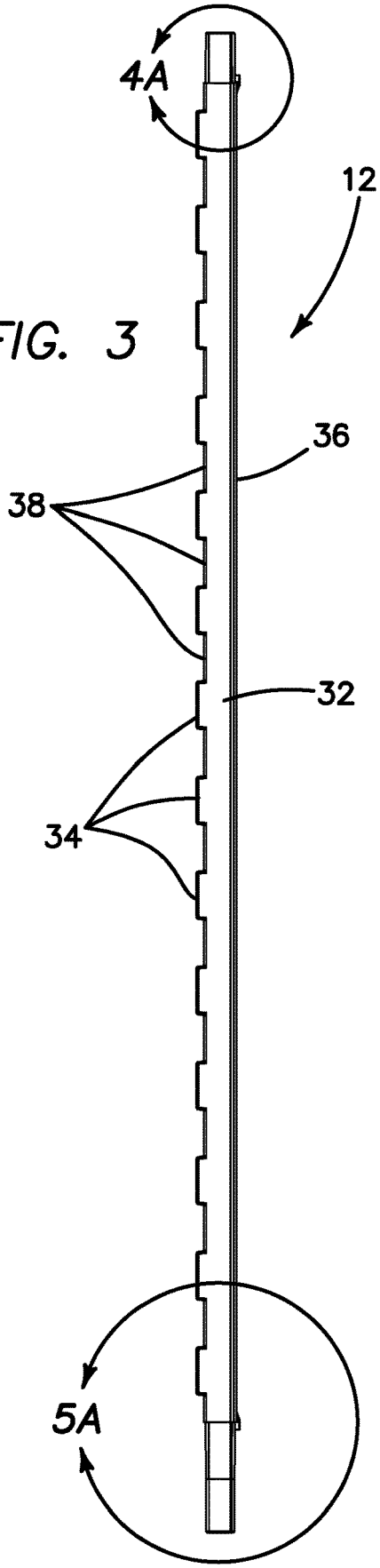
FIG. 3 is a side view of a post included within the shelving system of the current invention.

Greater detail of the vertical posts 12 may be had by turning to FIGS. 3-5B. As seen in FIG. 3, each vertical post 12 comprises an elongated body 32 with a smooth or flat outer surface 36 and an inner surface 38 which comprises a plurality of traverse coupling positions 34 disposed along the height of the vertical post.

Figure 4A:
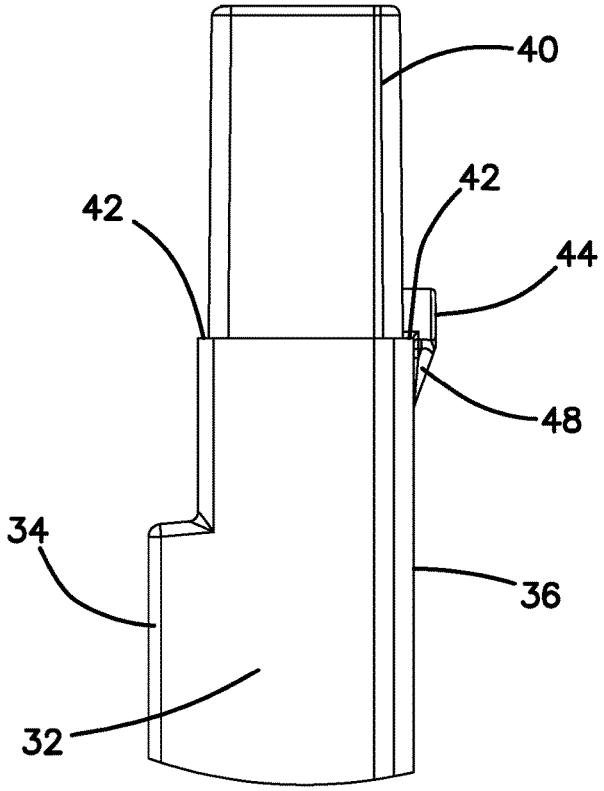
FIG. 4A is a magnified side view of the top portion of the post seen in FIG. 3.

The top and bottom portions of each vertical post 12 may be seen in FIGS. 4A-4B and 5A-5B, respectively. In FIGS. 4A and 48, it can be seen that the top portion of each vertical post 12 comprises a top coupling portion 40 which comprises a slightly smaller width or cross sectional area than the body 32 of the vertical post 12 from which the top coupling portion 40 extends. Because the top coupling portion 40 has a smaller cross sectional area relative to the body 32, a stop 42 is formed around the entire circumference or perimeter of the vertical post 12, specifically at the intersection or joint between the body 32 and the top coupling portion 40. Also disposed at the joint or stop 42 between the body 32 and the top coupling portion 40 is a male frictional engagement member 44 and a member support 48. The male frictional engagement member 44 extends perpendicularly outward from a longitudinal axis of the top coupling portion 40 beyond the vertical plane defined by the outer surface 36 of the body 32. The member support 48 is coupled or integrally formed with a bottom portion of the male frictional engagement member 44 and extends vertically downward, over the outer surface 36 of the body 32 portion of the vertical post 12. As seen in FIG. 4A, the member support 48 is substantially tapered in the vertical direction, specifically with a maximum height at or near the male frictional engagement member 44 and a decreasing height as the member support 48 is disposed downward vertically relative to the body 32 until becoming flush or even with the outer surface 36 of the body 32.

Figure 5A:
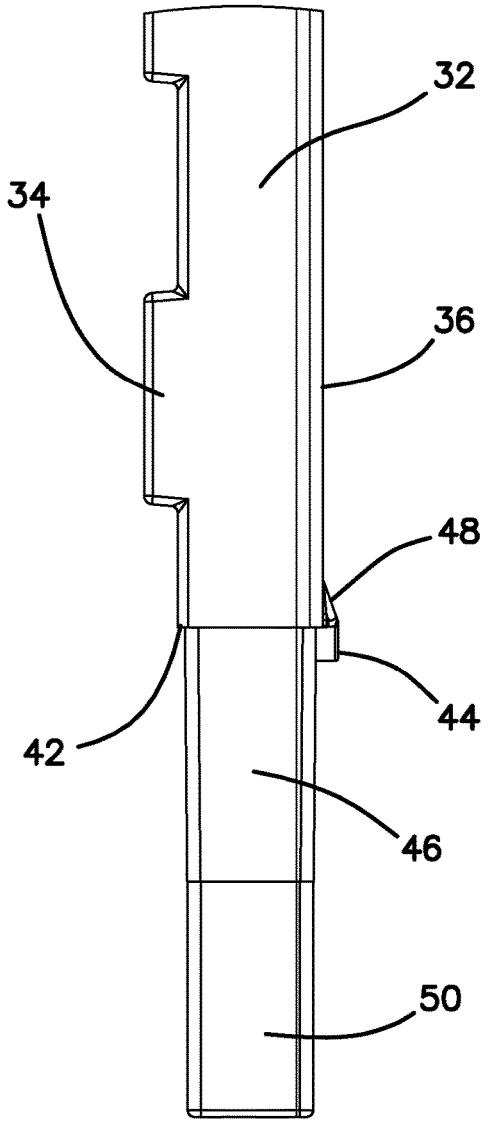
FIG. 5A is a magnified side view of the bottom portion of the post seen in FIG. 3.
Figure 5B:
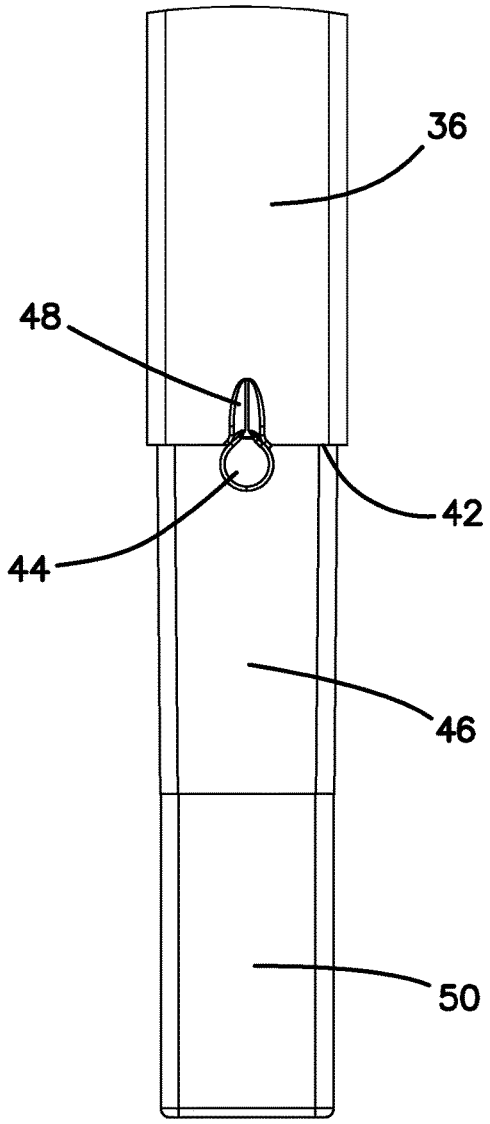
FIG. 5B is a frontal view of the top portion of the post seen in FIG. 5A.

Turning to FIGS. 5A and 5B, the bottom portion of each vertical post 12 is seen which comprises a bottom coupling portion 46 which comprises a slightly smaller width or cross sectional area than the body 32 of the vertical post 12 from which the bottom coupling portion 46 extends. Like the top coupling portion 40 discussed above, because the bottom coupling portion 46 has a smaller cross sectional area relative to the body 32, a stop 42 is formed around the entire circumference or perimeter of the vertical post 12, specifically at the intersection or joint between the body 32 and the bottom coupling portion 46. Also disposed at the joint or stop 42 between the body 32 and the bottom coupling portion 46 is a male frictional engagement member 44 and a member support 48. The male frictional engagement member 44 extends perpendicularly outward from a longitudinal axis of the bottom coupling portion 46 beyond the vertical plane defined by the outer surface 36 of the body 32. In this instance, the member support 48 is coupled or integrally formed with a top portion of the male frictional engagement member 44 and extends vertically upward, over the outer surface 36 of the body 32 portion of the vertical post 12. As seen in FIG. 5A, the member support 48 is substantially tapered in the vertical direction, specifically with a maximum height at or near the male frictional engagement member 44 and a decreasing height as the member support 48 is disposed upward vertically relative to the body 32 until becoming flush or even with the outer surface 36 of the body 32. Disposed beneath the bottom coupling portion 46 is a foot 50 which makes contact with the ground or surface on which the shelving system 10 rests. The foot 50 may be comprised of the same pultruded material as the body 32 of the vertical posts 12, or alternatively, may be comprised of a different form of plastic such as injection molded plastic or a different material entirely such as metal or rubber.

Figure 4B:
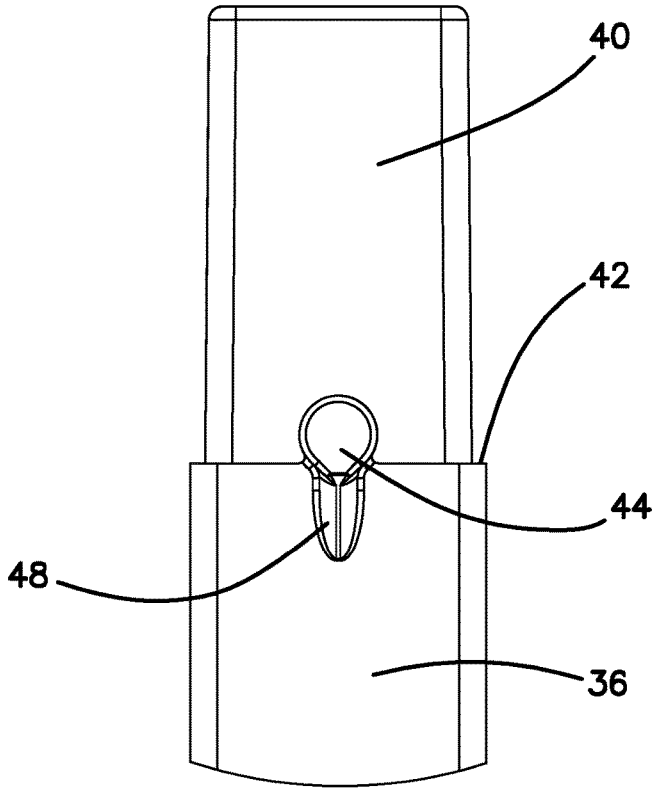
FIG. 4B is a frontal view of the top portion of the post seen in FIG. 4A.

Regardless where it is disposed relative to the body 32 of the vertical post 12, the male frictional engagement member 44 seen in FIGS. 4B and 58 is seen as being substantially circular, semi-circular, or cylindrical in shape, however it is to be expressly understood that other shapes, sizes, or configurations may be used without departing from the original spirit and scope of the invention. For example, the male frictional engagement member 44 may comprise any shape which is capable or configured to frictionally engage another component into which the male frictional engagement member 44 is inserted, specifically over a majority of its outer surface as defined by the shape of the male frictional engagement member 44 itself. Such shapes or configurations include but are not limited to a tetrahedron, cuboid, sphere, cone, helix, or some combination thereof. Additionally, while the male frictional engagement member 44 is seen in FIGS. 4B and 5B as a cylinder with substantially smooth surfaces, it is to be expressly understood that the male frictional engagement member 44 may comprise an additional surface or structural feature beyond what is provided by the general shape of the male frictional engagement member 44 itself. For example, the male frictional engagement member 44 may comprise a helical screw thread, a toggle bolt, a notch or defined aperture, an anchor, or other receiving joint which is capable of creating or forming a contact point or other frictional surface. Additionally, construction material substances such as adhesive or mortar may be applied over the surface of the male frictional engagement member 44 to enhance its ability to couple or affix itself to another component.

Figure 7:
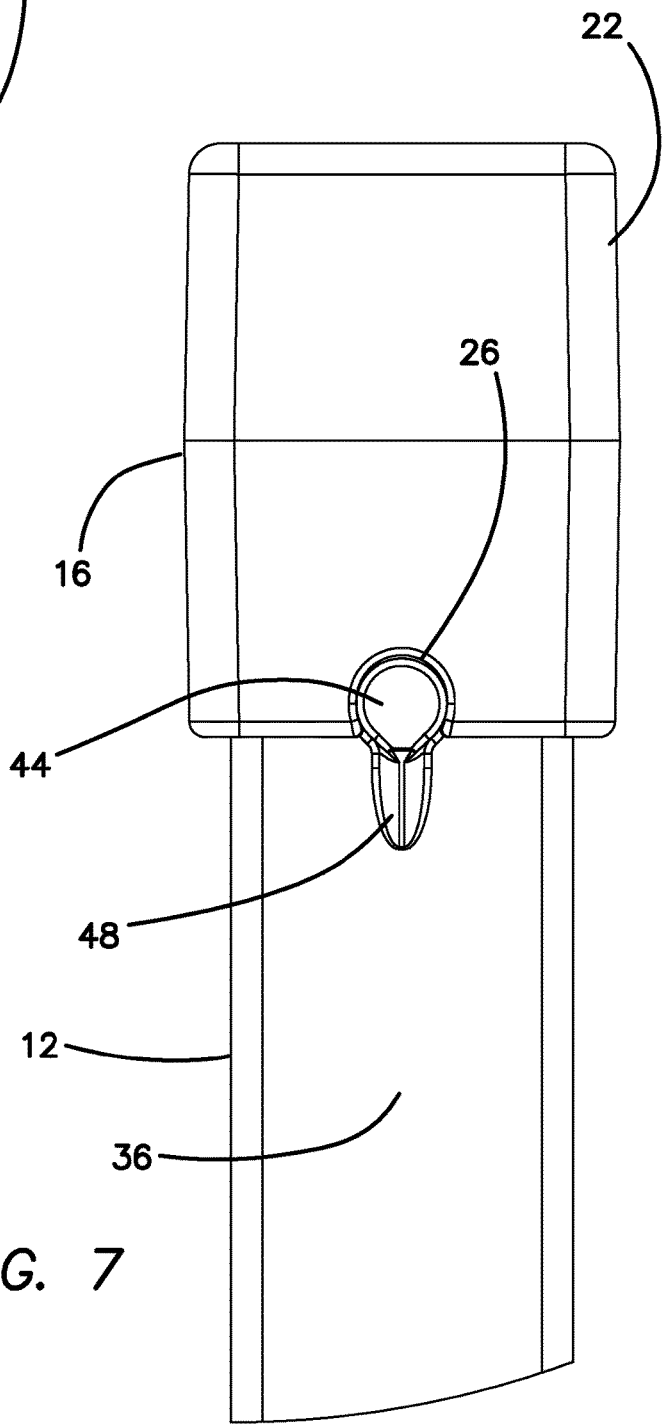
FIG. 7 is a magnified frontal view of the post cap seen in FIG. 2C after being coupled to the top portion of a post.
Figure 10A:
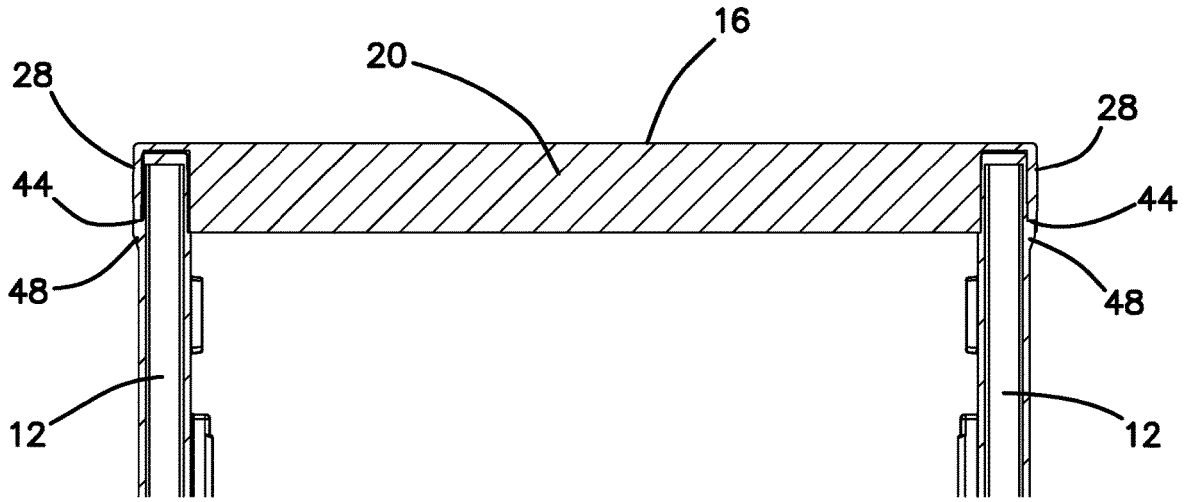
FIG. 10A is a cross sectional view of the top post connector coupled to a pair of posts.

Turning to FIGS. 4B and 7, the frictional coupling or engagement between the top post connector 16 and a vertical post 12 may be seen. First, the top post connector 16 is disposed over the top coupling portion 40 of the vertical post 12, specifically with the post aperture 24 defined in the bottom surface of the post cap 22 aligned or disposed directly over the top coupling portion 40. The post cap 22 is brought vertically downward over the top coupling portion 40 so that it enters or is inserted through the post aperture 24 and into the hollow interior volume of the post cap 22. As the top post connector 16 is pushed downward, the male frictional engagement member 44 disposed on the body 36 of the vertical post 12 is inserted or moves into the female frictional engagement member 26 defined within the post cap 22. The male frictional engagement member 44 is nested within the female frictional engagement member 26 so that an entirety of an internal surface of the female frictional engagement member 26 is in physical contact with a corresponding outside surface of the male frictional engagement member 44. At the same time the male frictional engagement member 44 is inserted into the female frictional engagement member 26, a bottom portion or edge of the post cap 22 makes contact with the stop 42 disposed between the body 36 and the top coupling portion 40. After making contact with the male frictional engagement member 44 and the stop 42, all further downward movement of the post cap 22 and thus the top post connector 16 as a whole relative to the vertical post 12 is prevented. Each post cap 22 of the top post connector 16 may be coupled to a vertical post 12 individually, or the post caps 22 may be coupled to two different vertical posts 12 simultaneously, thereby helping form one lateral side of the shelving system 10 as seen in FIG. 10A.

Figure 8:
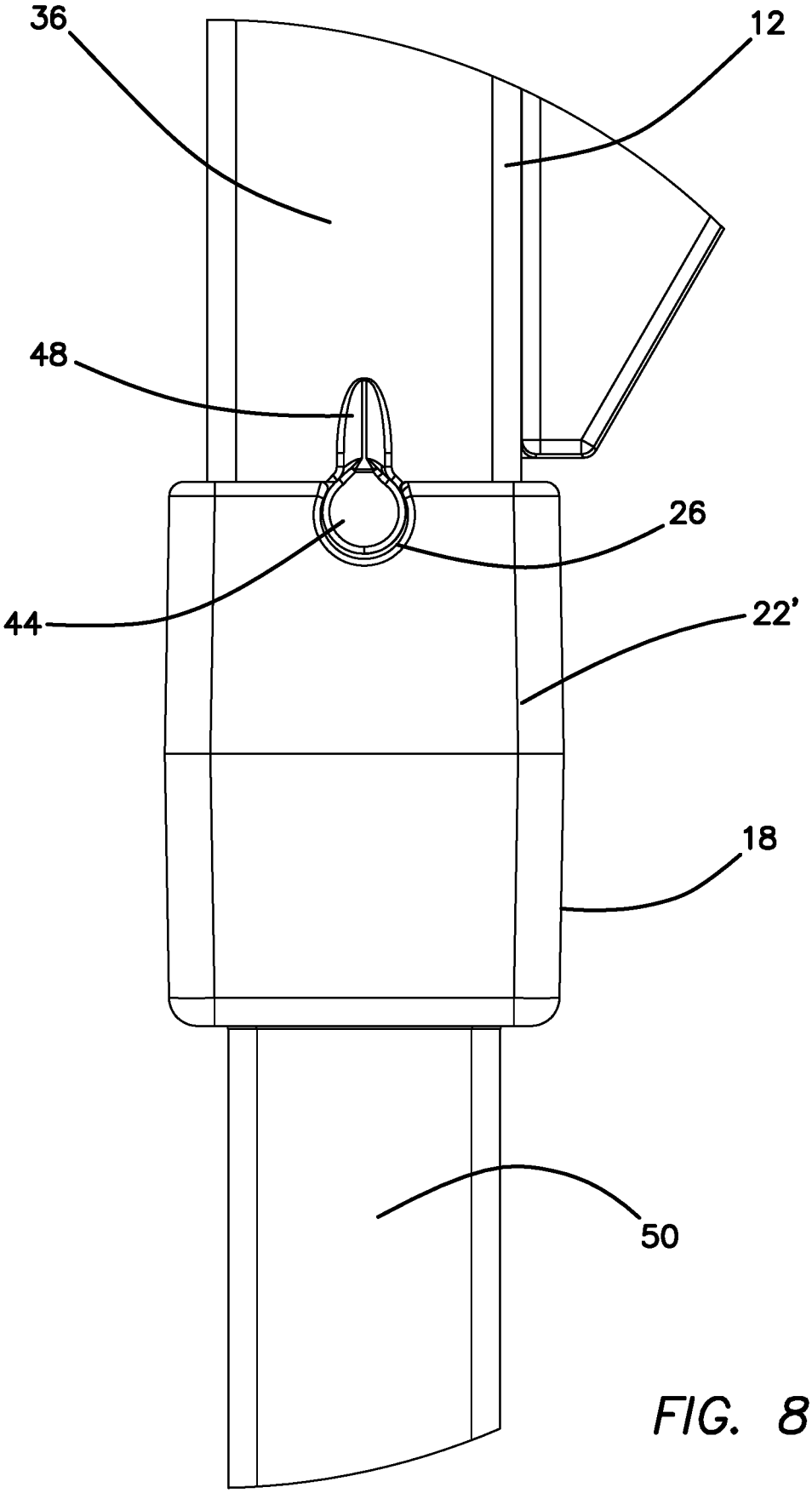
FIG. 8 is a magnified frontal view of the post sleeve seen in FIG. 6B after being coupled to the bottom portion of a post.
Figure 10B:
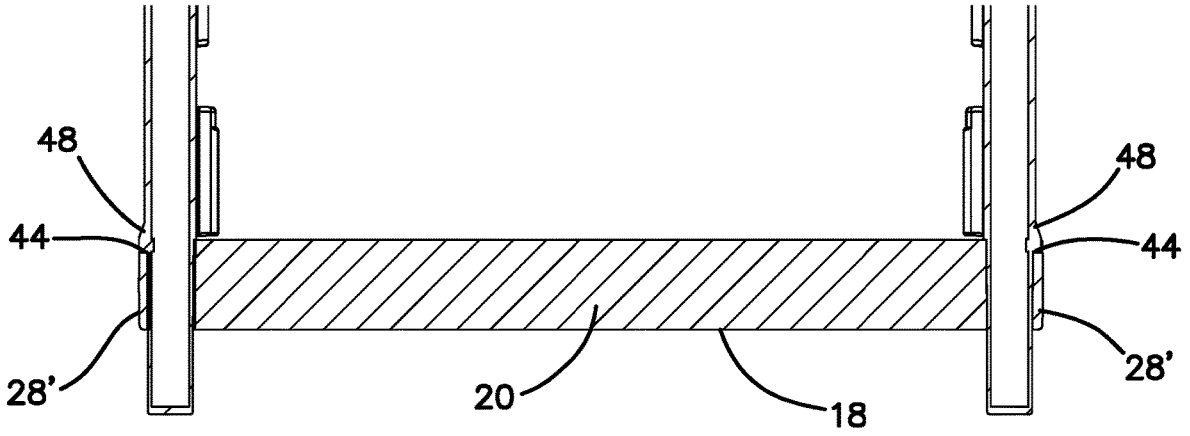
FIG. 10B is a cross sectional view of the bottom post connector coupled to a pair of posts.

The frictional coupling or engagement between the bottom post connector 18 and a vertical post 12 may be seen in FIGS. 5B and 8. First, the bottom post connector 18 is disposed beneath or under the foot 50 and bottom coupling portion 46 of the vertical post 12, specifically with the post aperture 24 defined in the top surface of the post sleeve 22' aligned or disposed directly under the bottom coupling portion 46. The post sleeve 22' is brought vertically upward over the foot 50 and bottom coupling portion 46 so that it enters or is inserted through the post aperture 24 and into the hollow interior volume of the post sleeve 22'. Because a post aperture 24 is defined through both the top and bottom surfaces of the post sleeve 22', as the bottom post connector 18 is moved over the height of the vertical post 12 the foot 50 is allowed to extend through or traverse the entire height of the post sleeve 22' and exit through the opposing side as seen in FIG. 10B, thereby allowing the bottom post connector 18 to then move over the bottom coupling portion 46. As the bottom post connector 18 is further pushed or moved upward over the bottom coupling portion 46, the male frictional engagement member 44 disposed on the body 36 of the vertical post 12 is inserted or moves into the female frictional engagement member 26 defined within the post sleeve 22'. The male frictional engagement member 44 is nested within the female frictional engagement member 26 so that an entirety of an internal surface of the female frictional engagement member 26 is in physical contact with a corresponding outside surface of the male frictional engagement member 44. At the same time the male frictional engagement member 44 is inserted into the female frictional engagement member 26, a top portion or edge of the post sleeve 22' makes contact with the stop 42 disposed between the body 36 and the bottom coupling portion 46. After making contact with the male frictional engagement member 44 and the stop 42, all further upward movement of the post sleeve 22' and thus the bottom post connector 18 as a whole relative to the vertical post 12 is prevented. Each post sleeve 22' of the bottom post connector 18 may be coupled to a vertical post 12 individually, or the post sleeves 22' may be coupled to two different vertical posts 12 simultaneously, thereby helping form one lateral side of the shelving system 10 as seen in FIG. 10B.

It is important to note that the frictional engagement between the vertical posts 12 and both the top post connector 16 and the bottom post connector 18 is a key aspect in maintaining the overall structural integrity of the shelving system 10, particularly with regard to withstanding applied horizontal or shear forces. Specifically, as best seen in FIGS. 7 and 8 and as discussed above, both the male frictional engagement member 44 and the correspondingly shaped female frictional engagement member 26 each comprise substantially circular shapes or otherwise comprise at least one surface which is rounded, curved, or containing at least one segment defined by an arc. By having correspondingly shaped or mirror-image curved surfaces between the male and female frictional engagement members 44, 26, the amount of surface contact between the male and female frictional engagement members 44, 26 is increased relative to what would be possible employing a straight or angled contact surface. A large amount of surface contact in turn leads to a large amount of friction between the male and female frictional engagement members 44, 26 which helps keep the top and bottom post connectors 16, 18 firmly coupled to their respective positions along each vertical post 12.

Figure 9:
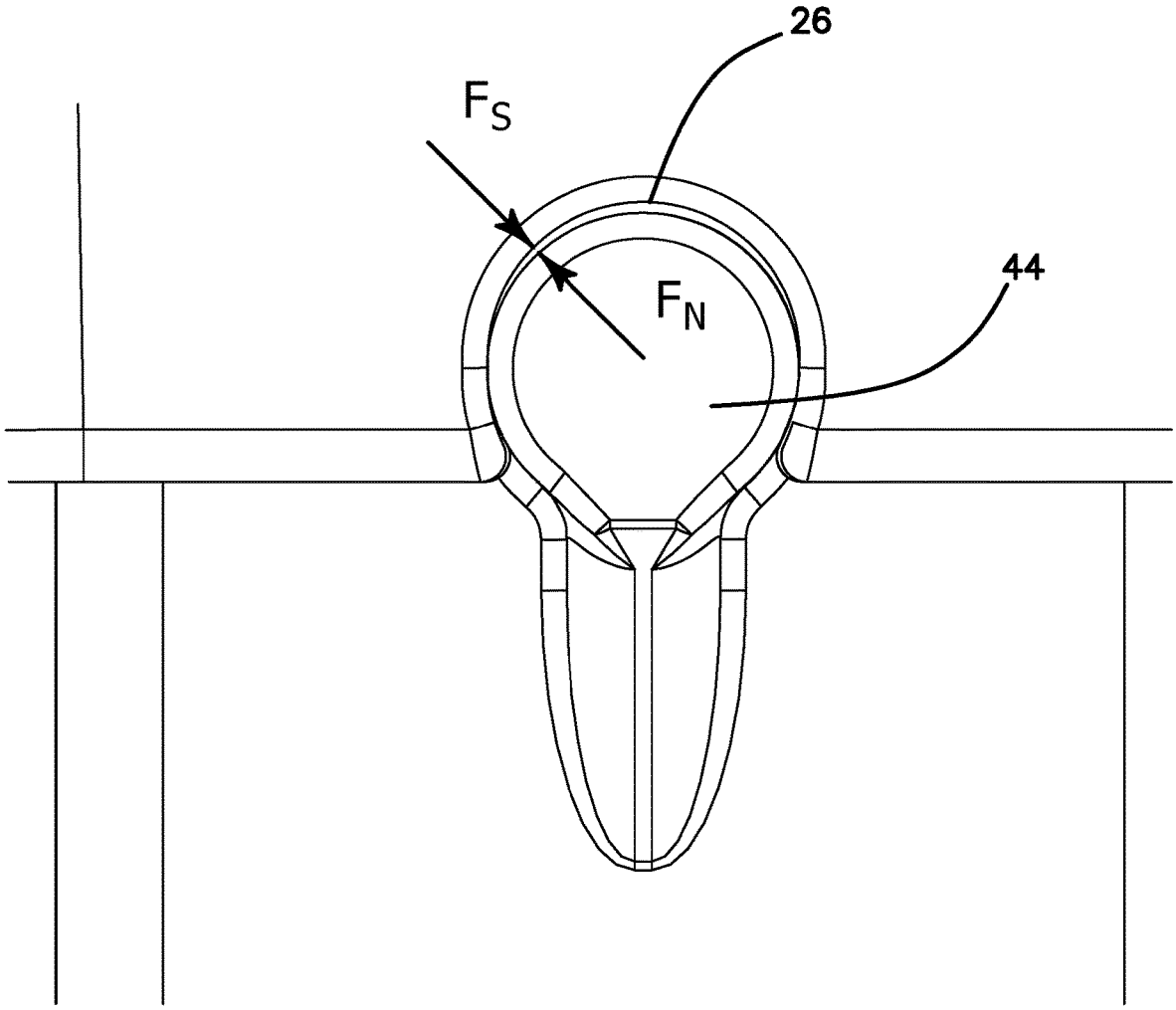
FIG. 9 is a magnified view of the coupling between a male frictional engagement member of a post and a female frictional engagement member of either a top or bottom post connector.

Additionally, because the male and female frictional engagement members 44, 26 form a substantially concentric configuration when coupled together, any shear forces applied or exerted to any portion of the shelving system 10 is met with a radial reactive force which opposes the applied shear force in both direction and magnitude. For example, if a shear force Fs as seen in FIG. 9 is applied to the shelving system 10 in the direction shown, a reaction force FR of equal magnitude but of opposing orientation will emanate from the surface contact between the male and female frictional engagement members 44, 26. As well understood, the reaction force FR helps counteract or resist any acceleration resulting from the applied shear force Fs, thereby helping the shelving system 10 as a whole maintain a relatively stable support structure for any items stored within the shelving system 10. The substantially concentric configuration formed by the male and female frictional engagement members 44, 26 ensures that a corresponding radial reaction force FR is generated by the shelving system 10 regardless of the direction or orientation of the applied or incoming shear force Fs.

Figure 11:
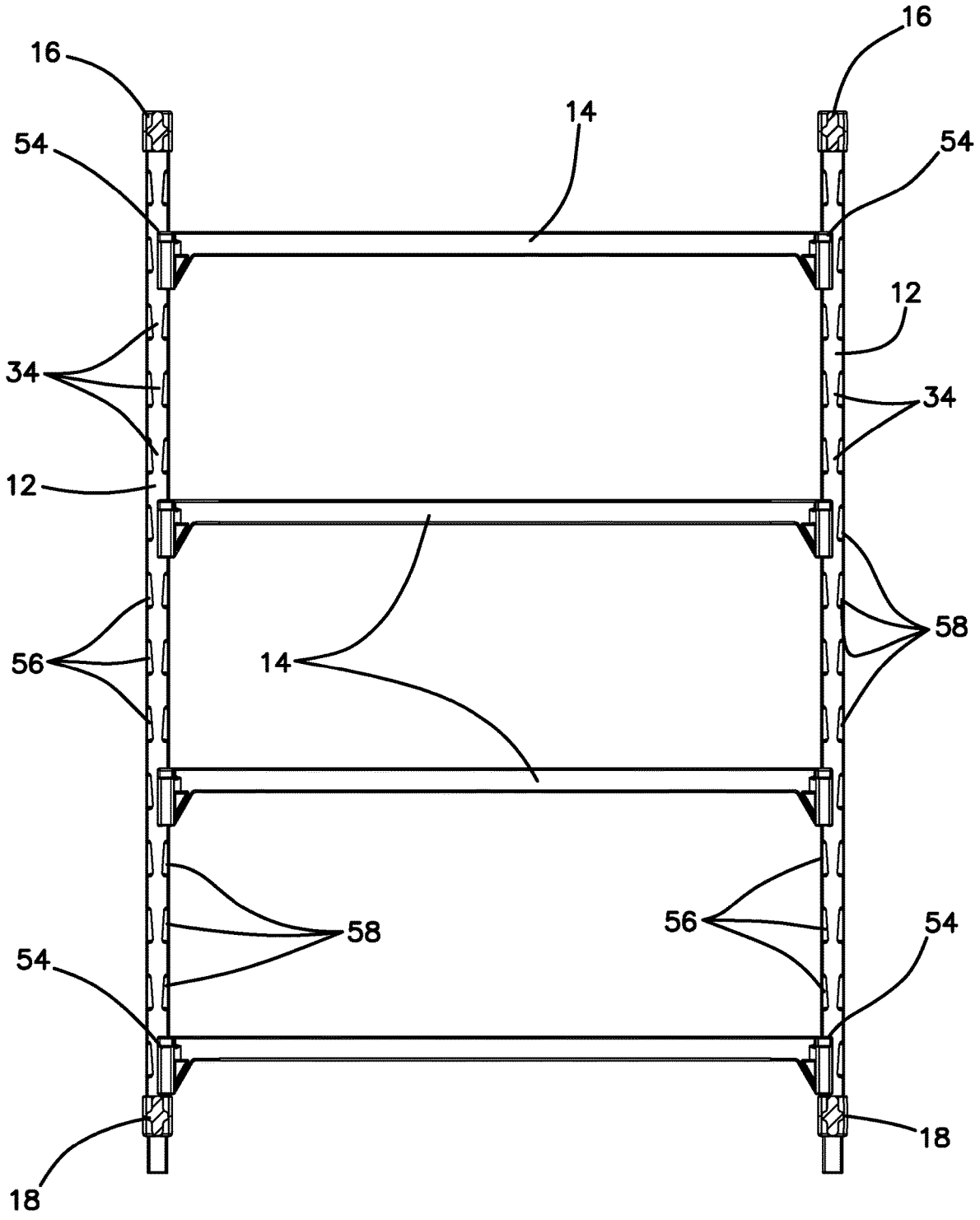
FIG. 11 is a cross sectional longitudinal view of the shelving system seen in FIG. 1A.
Figure 12A:
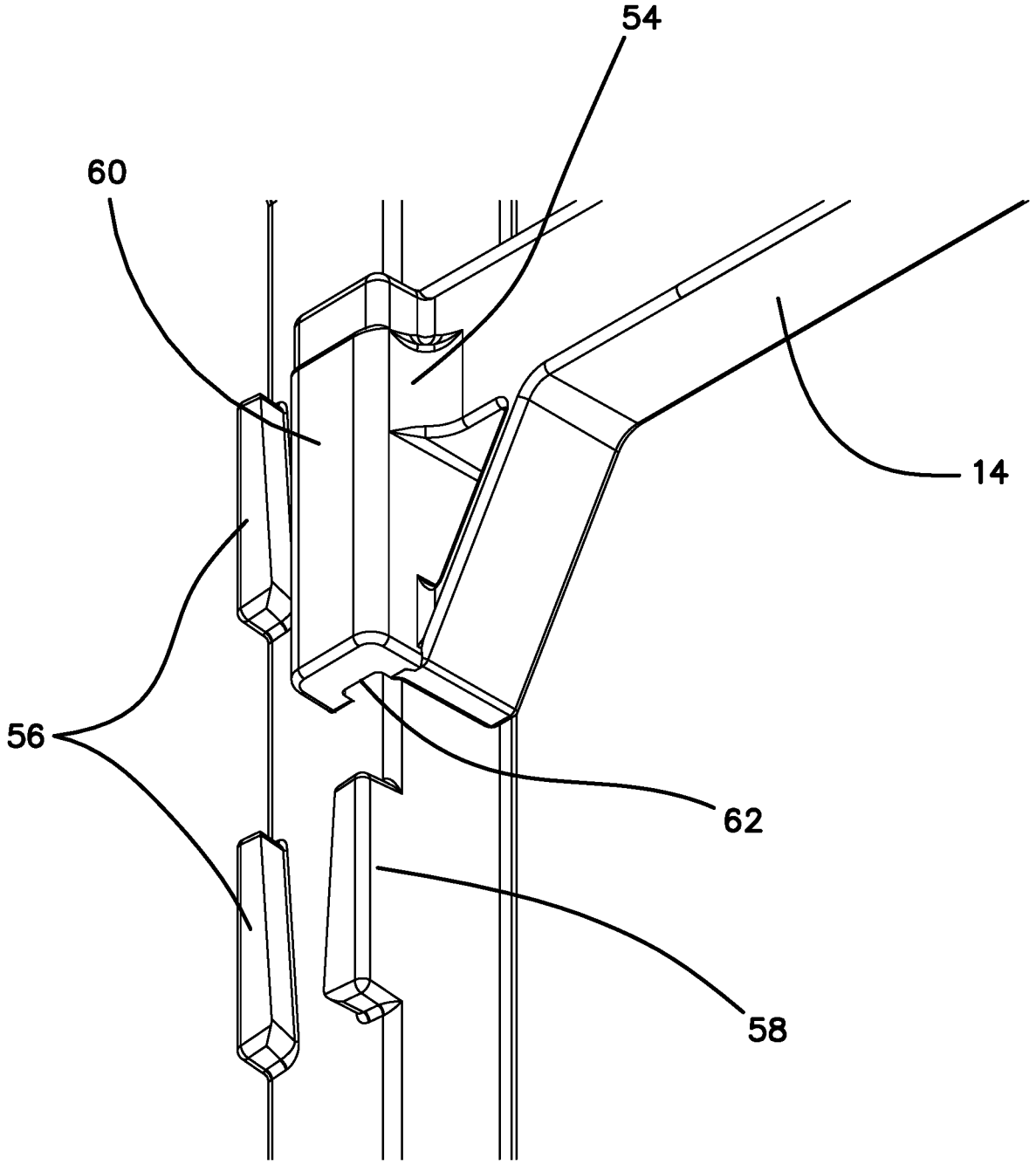
FIG. 12A is a bottom perspective view of a traverse end piece coupled to a first male component defining the traverse coupling positions disposed along the height of a post.
Figure 12B:
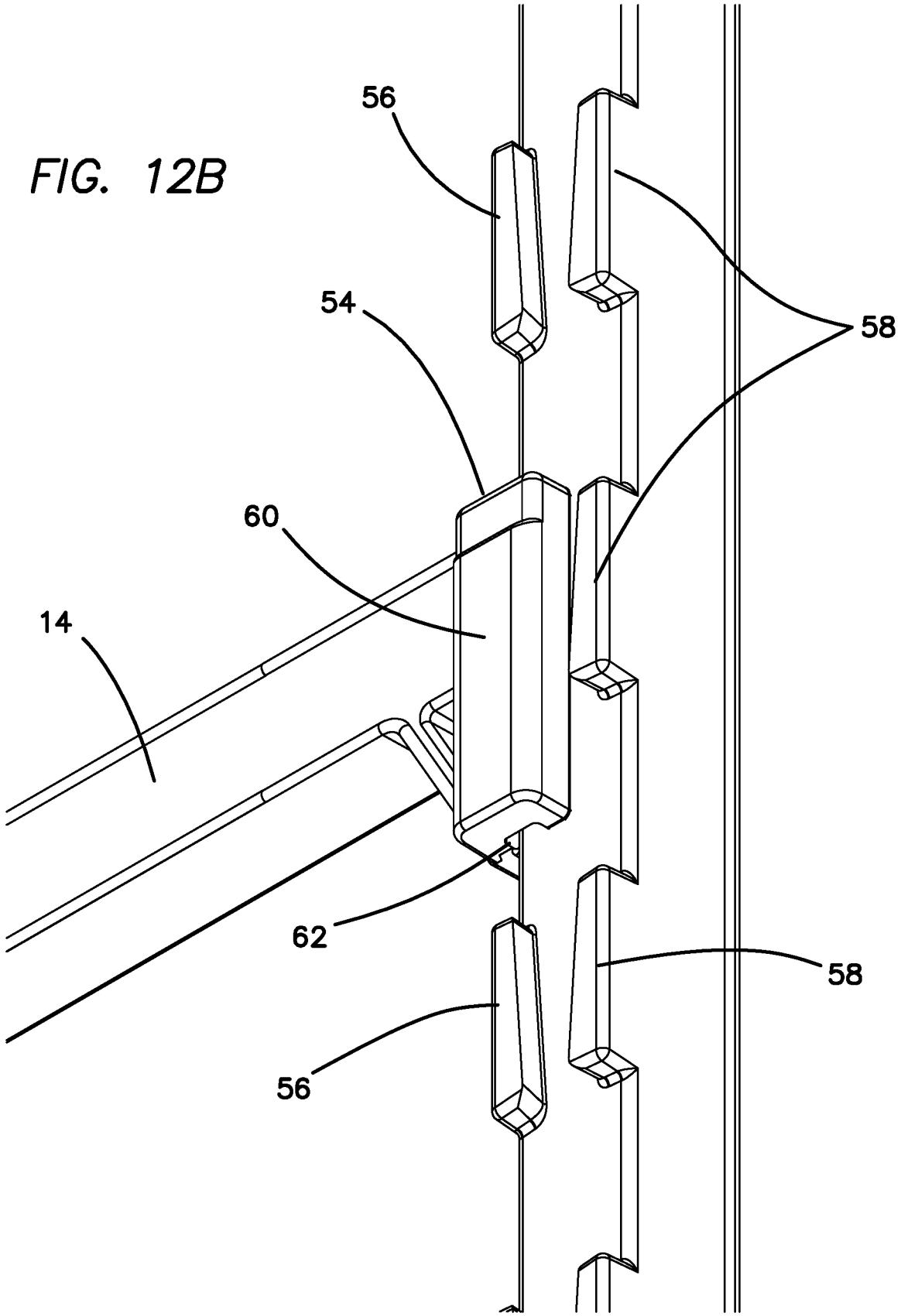
FIG. 12B is a bottom perspective view of a traverse end piece coupled to a second male component defining the traverse coupling positions disposed along the height of a post.
Figure 12C:
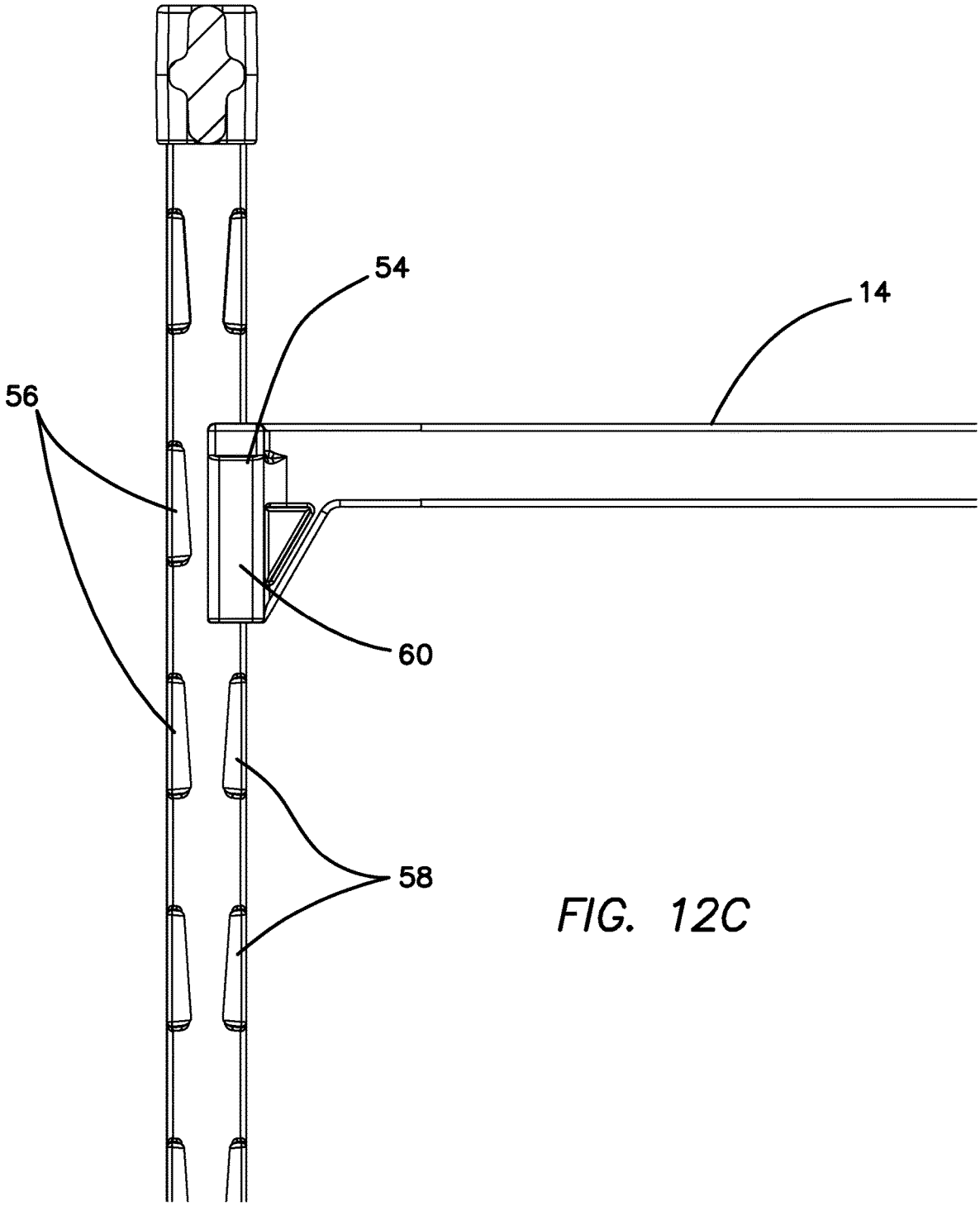
FIG. 12C is a frontal view of the traverse end piece coupled to the first male component seen in FIG. 12A.
Figure 13:
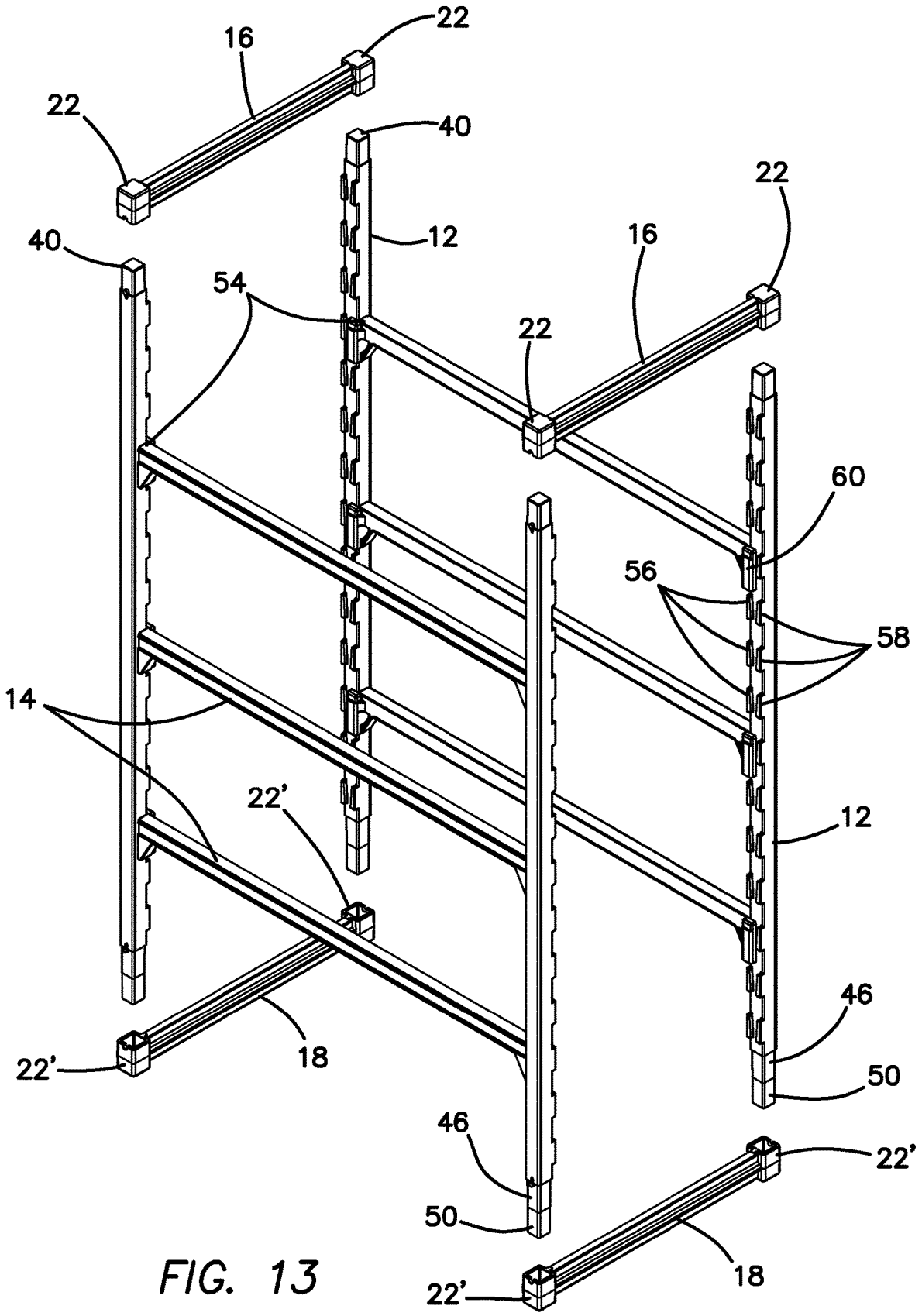
FIG. 13 is a perspective exploded view of the shelving system seen in FIG. 1A.

Detail of how the plurality of traverses 14 are coupled to one or more vertical posts 12 may be seen by turning to FIGS. 11-12C. Each traverse 14 comprises a substantially rectangular or parallelepiped shaped body 52 which is comprised of pultruded plastic or plastic composites. Disposed or coupled to either lateral end of the body 52 is a traverse end piece 54. Each traverse end piece 54 may be coupled to a traverse 14 or alternatively, may be integrally formed with the traverse 14 to form one solid component. In turn, each vertical post 12 comprises a plurality of traverse coupling positions 34 which each comprise a first male component 56 and a second male component 58, the second male component 58 being adjacently disposed in close proximity and at the same vertical position as the first male component 56 along the vertical post 12. Each of the traverse coupling positions 34 represents a height along the vertical post 12 at which a traverse 14 may be coupled or disposed, thereby providing a platform or means for accommodating items or goods at that specified height within the shelving system 10 as a whole.

As seen in greater detail in FIGS. 12A-120, both the first male component 56 and the second male component 58 comprise a substantially tapered or dove-tailed width while having a substantially rectangular or block-shaped depth as best seen in FIG. 5A. The first and second male components 56, 58 specifically comprise a first width at a top or proximal portion which widens or enlarges along the vertical height of the first and second male components 56, 58 so that a maximum second width is obtained at a bottom or distal portion of each of the first and second male components 56, 58, the second width being larger or wider than the first width. In contrast, each first and second male components 56, 58 comprises a depth which is consistent along its entire height, thereby providing a substantially straight or rectangular shaped profile best seen in FIG. 5A. The first male component 56 and the second male component 58 further comprise asymmetric configurations or shapes so that an outside edge of each of the first and second male components 56, 58 remains straight throughout their respective heights, while their corresponding inside edges, namely the edges which are closest to the center of the vertical post 12, flare out or gradually widen when moving from the top or proximal portion of the first and second male components 56, 58 to their respective bottom or distal portions. Furthermore, as best seen in FIG. 12C, the first and second male components 56, 58 are inversely orientated relative to one another so as to form a substantial mirror-image configuration. In other words, the tapered inside edges of the first and second male components 56, 58 forming each traverse coupling position 34 are orientated so as to be facing one another and thereby form a substantial "V" shape within the negative space disposed between the first and second male components 56, 58.

In order to couple a traverse 14 to a vertical post 12, a user first brings a traverse end piece 54 to a selected traverse coupling position 34 that is disposed at the desired height along the vertical post 12 at which the user wishes to provide a shelf within the overall shelving system 10. The user then slides a collar 60 portion of the traverse end piece 54 down onto either the first or second male components 56, 58 forming the traverse coupling position 34, depending upon which side of the vertical post 12 the user wishes to couple the traverse 14 to. The collar 60 comprises a female aperture 62 defined in its inner facing surface so that as the collar 60 is being slid over the first or second male component 56, 58, the male component 56, 58 is inserted into the female aperture 62, thereby joining the traverse 14 to the vertical post 12.

In a preferred embodiment, the female aperture 62 comprises a substantially tapered or dove-tailed shape which is similar to the tapered shape of the first and second male components 56, 58. Specifically, the female aperture 62 specifically comprises a first width at a top or proximal portion which widens or enlarges along the vertical height of the female aperture 62 so that a maximum second width is obtained at a bottom or distal portion of the female aperture 62, the second width being larger or wider than the first width. In the embodiment of the traverse end piece 54 seen in FIGS. 12A and 12C where the collar 60 is coupled to one of the plurality of second male components 58, the female aperture 62 is defined so as to specifically accommodate or envelope the second male component 58. In a related embodiment of the traverse end piece 54 seen in FIG. 12B where the collar 60 is coupled to one of the plurality of first male components 56, the female aperture 62 is in turn defined so as to specifically accommodate or envelope the first male component 56. It is therefore contemplated that a single traverse 14 which comprises a traverse end piece 54 disposed at either end may be so configured so as to specifically comprise collars 60 which have female apertures 62 defined therein that are capable of coupling to a first male component 56 of a first vertical post 12 and to a second male component 58 of a separate, adjacent vertical post 12 as seen in FIG. 11.

It is important to point out that due the substantially dove-tailed shapes of both the female aperture 62 of the collar 60 and the first and second male components 56, 58 of the traverse end piece 54, the further the female aperture 62 is slid distally downward over the first and second male components 56, 58, the more force that is created and directed toward the center of the vertical post 12. In other words, because the female apertures 62 and the first and second male components 56, 58 comprise a dove-tailed width along their length, as the female aperture 62 and the male component 56, 58 are brought together, a static force is created which pushes the collar 60 into the vertical post 12. As more weight is added to the traverse 14, either directly or indirectly through a shelf or shelf-plate disposed on the traverse 14, the larger the static force becomes which in turn further pushes the collar 60 into the vertical post 12. The post 12 in turn responds with a reactionary force that pushes the collar 60 in the opposite direction to that of the inward force created by the load placed on the traverse 14, thus maintaining static equilibrium between the traverse 14 and vertical post 12. The combination of the force distribution scheme provided by the dove-tailed shaped components with the strength provided by the traverses 14 and posts 12 fabricated by pultrusion allows for large load amounts to be placed on the traverses 14 and thus by extension, on the entire shelving system 10 as a whole without the fear of structural failure.

Once the collar 60 of the traverse end piece 54 is fully slid down about the male components 56, 58 until a top portion of the selected male component 56, 58 makes contact with a top surface of the female aperture 62, a maximum force is created that squeezes the collar 50 tightly to the vertical post 12 and thus eliminates any need for any further coupling means. The same coupling process described above is then repeated for the opposing end of traverse 14 thus leaving the traverse 14 firmly in place laterally between two primary posts 12 on either side of the shelving system 10 as seen in FIGS. 1A-1C and 11.

To remove or decouple the traverse 14 from the post 12, the user pushes up on the traverse 14 and the traverse end piece 54. In doing so, the collar 60 of the traverse end piece 54 moves vertically up the male component 56, 58 on which it is disposed. The female aperture 62 slides vertically up the male component 56, 58, decreasing the amount of force applied to the vertical post 12 by the collar 60 along the way. Once the female aperture 62 is clear of the male component 56, 58, the user is then free to remove one or both of the traverse end pieces 54 from the vertical post 12. The user may simply remove the traverse 14 from the shelving system 10 completely, or alternatively insert each of the traverse end pieces 54 into a new pair of corresponding traverse coupling positions 34 and repeat the process described above.

An alternative embodiment of the shelving system 100 may be seen by turning to FIGS. 14-23B which shows a shelving system 100 with an alternative configuration and coupling means between a plurality of vertical uprights or posts 112, at least two top or upper fasteners or connectors 116, at least two bottom or lower fasteners or connectors 118, and a plurality of shelf supports or traverses 114. As with the prior embodiment, each of the top or upper connectors 116 are coupled to an upper end or top portion of at least two adjacently disposed vertical uprights or posts 112. Similarly, coupled to a bottom portion or lower end of at least two adjacently disposed vertical uprights or posts 112 is a bottom or lower connector 118. The at least two top or upper connectors 116 and the at least two bottom or lower connectors 118 are orientated perpendicularly relative to the plurality of shelf supports or traverses 14 as best seen in the perspective view of the shelving system 100 in FIG. 14A. Additionally, both the top or upper connectors 16 and bottom or lower connectors 18 are preferably comprised of injection molded plastic or plastic composites.

Figure 15A:
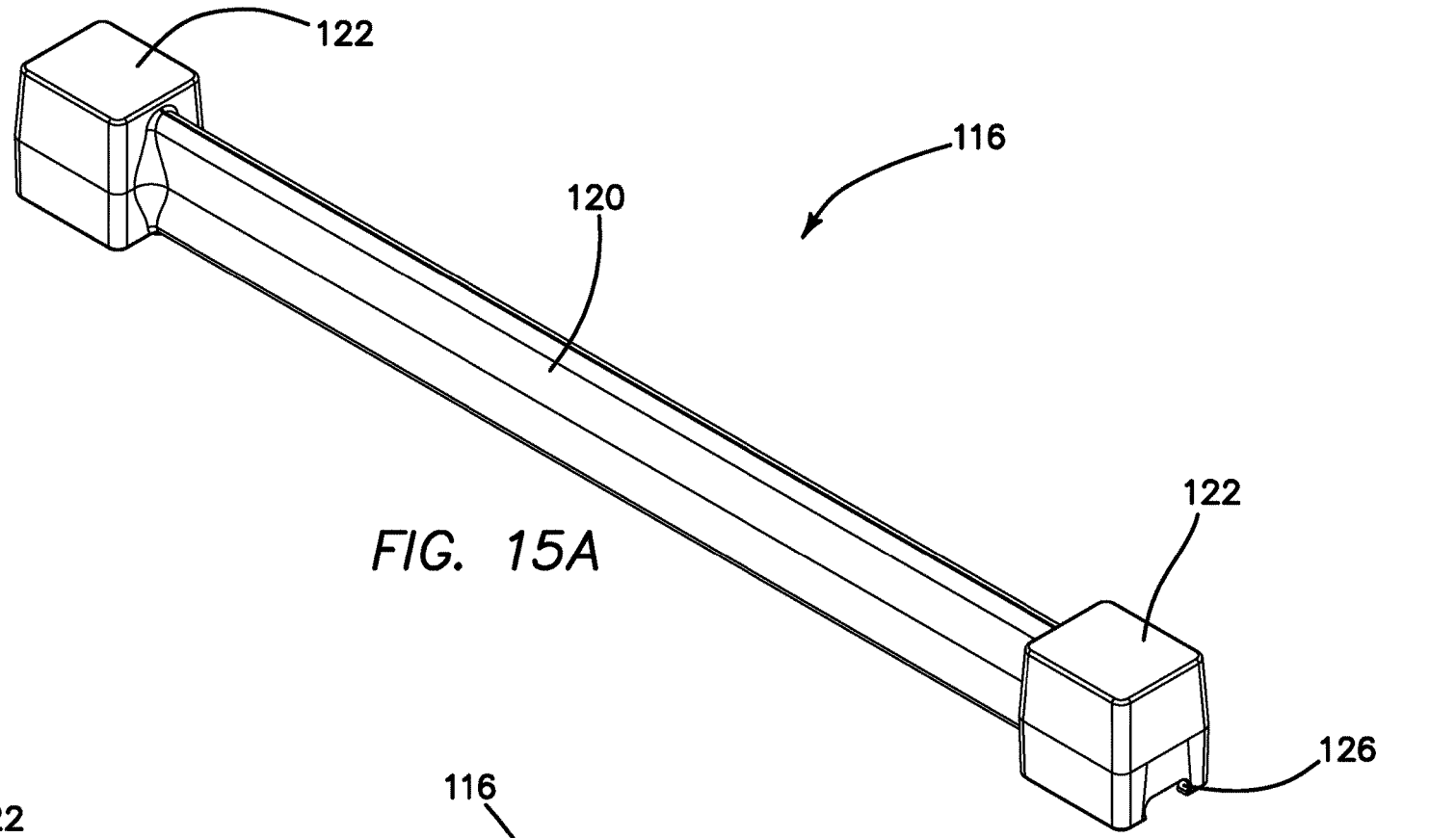
FIG. 15A is a perspective view of a top or upper fastener or connector used within the alternative embodiment of the shelving system.
Figure 15B:
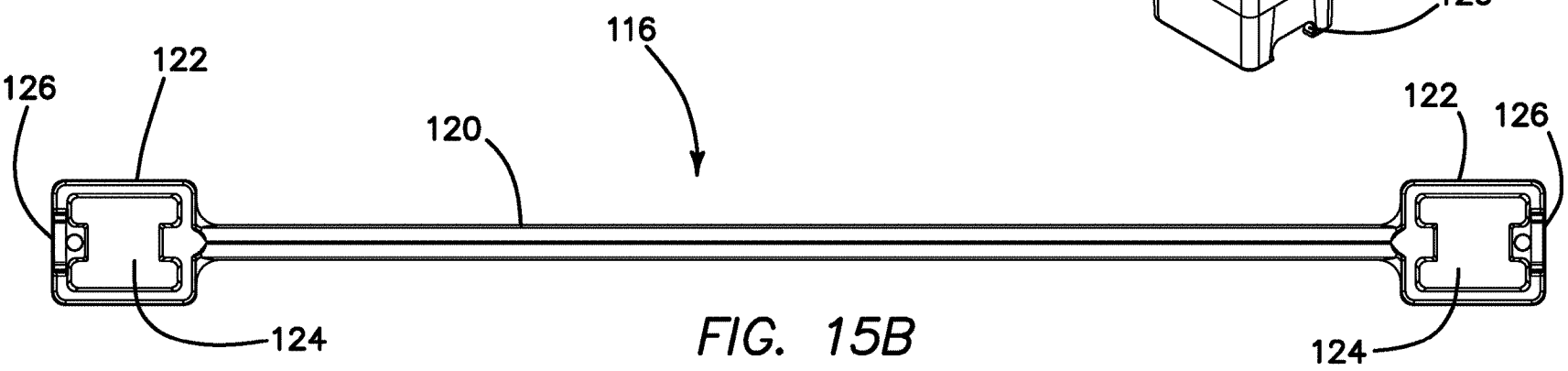
FIG. 15B is a bottom plan view of the top or upper fastener or connector seen in FIG. 15A.

Greater detail of the top or upper connectors 116 may be seen in FIGS. 15A and 15B. Each top or upper fastener or connector 116 comprises a substantially longitudinal bridge or crosspiece 120 with a substantially cuboidal or rectangular end piece or cap 122 disposed on either lateral end of the bridge or crosspiece 120. Each end piece or cap 122 comprises an opening or aperture 124 which is defined in its bottom surface and exposes its hollow interior. The cap 122 thereby forms a shell or covering so that a top portion or end of a vertical upright or post 112 may be accommodated or nested therein by being disposed or inserted into the internal hollow volume of the end piece or cap 122 through the opening or aperture 124 as is detailed further below.

Figure 16A:
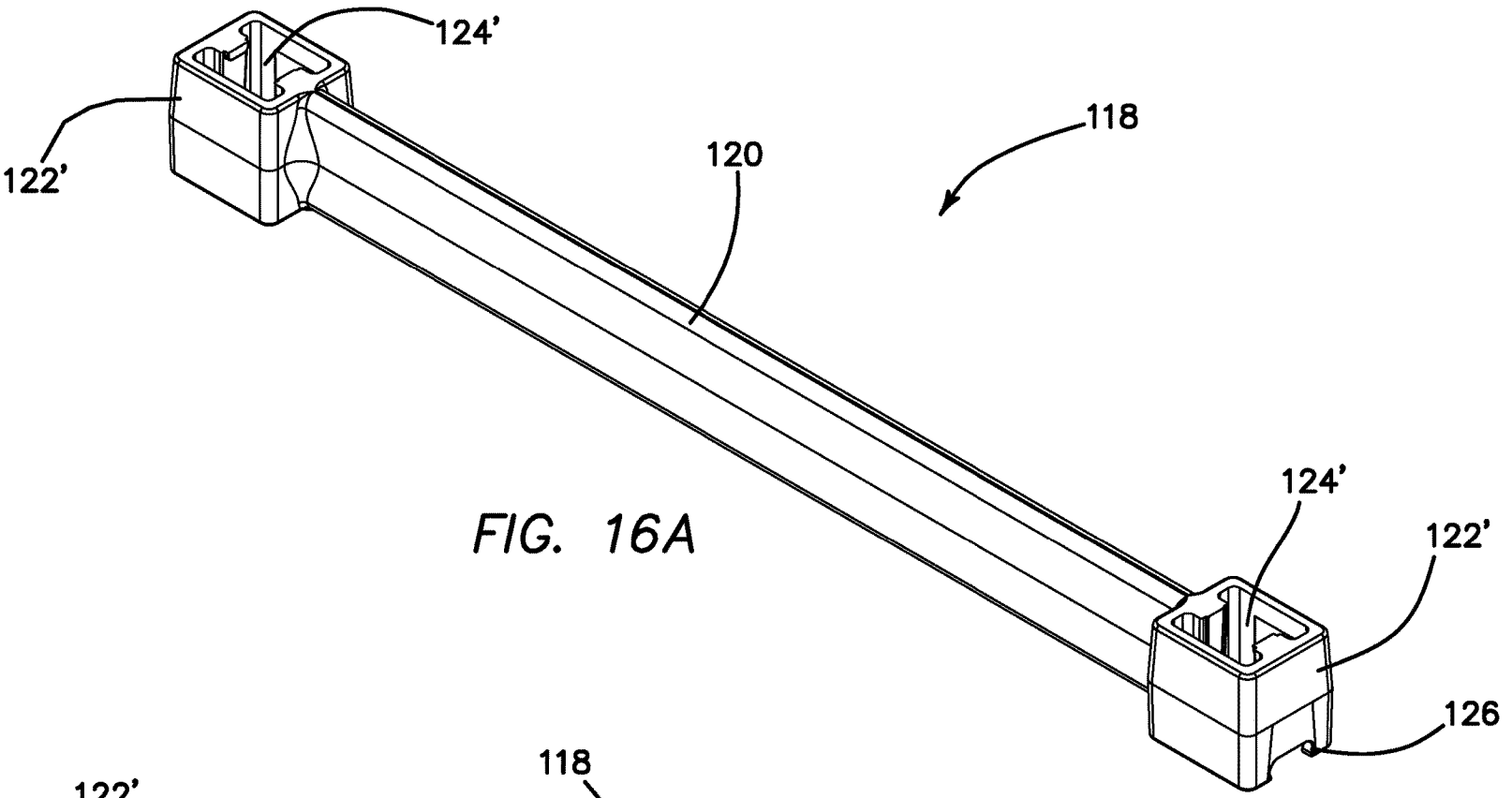
FIG. 16A is a perspective view of a bottom or lower fastener or connector used within the alternative embodiment of the shelving system.
Figure 16B:
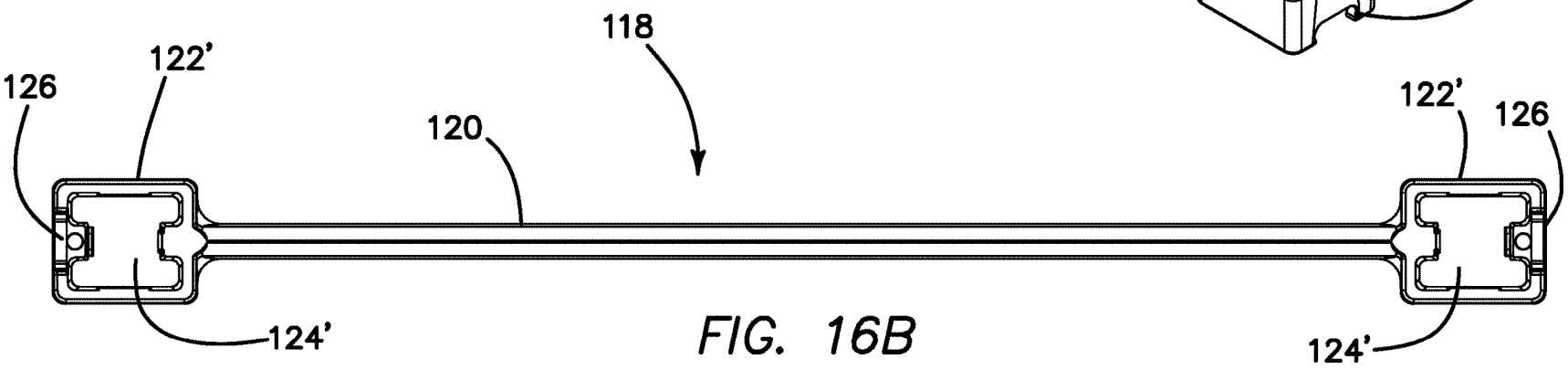
FIG. 16B is a bottom plan view of the bottom or lower fastener or connector seen in FIG. 16A.

FIGS. 16A and 16B show greater detail of the bottom or lower connectors 118. Like the top or upper connector 116 discussed above, each bottom or lower connector 118 comprises a substantially longitudinal bridge or crosspiece 120 with a substantially cuboidal or rectangular collar or sleeve 122' disposed on either lateral end of the crosspiece 120. Each collar or sleeve 122' comprises an opening or aperture 124' which is defined through its vertical height, thereby forming a shell or hollow volume so that the bottom portion or lower end of a vertical upright or post 112 may be accommodated, disposed, or inserted therein by aligning the internal volume of the collar or sleeve 122' with the vertical upright or post 112 as is detailed further below.

Each end piece or cap 122 and each collar or sleeve 122' comprises a cutout or female key 126 defined in at least one edge or surface of each respective end piece or cap 122 and each collar or sleeve 122'. Specifically, as best seen in the bottom view of the top or upper connector 116 of FIG. 15B and the perspective view of the bottom or lower connector 118 of FIG. 16A, the cutout or female key 126 is defined in at least one edge or surface of the end piece or cap 122 and the collar or sleeve 122' so as to form an asymmetrical bottom footprint, respectively. FIGS. 15A and 16A further specify that the cutout or female key 126 is defined at or approximate to the bottom of a front or outward facing surface of both the end piece or cap 122 and the collar or sleeve 122'. Additionally, the cutout or female key 126 is substantially centrally or symmetrically defined along a vertical axis of both the front or outward facing surface of the end piece or cap 122 and of the front surface or outward facing surface of the collar or sleeve 122'.

The cutout or female key 126 is seen in FIGS. 15A and 16A as being substantially oblong in shape or rectangular with semi-circular ends, however it is to be expressly understood that other shapes, sizes, or configurations may be used without departing from the original spirit and scope of the invention. For example, the cutout or female key 126 may comprise any shape which is capable or configured to frictionally engage another component inserted into it over a majority of its inner surface as defined within the respective front surfaces of the end piece or cap 122 and the collar or sleeve 122'. Such shapes or configurations include but are not limited to triangular, rectangular or parallelepiped, pentagonal, hexagonal, or octagonal. Additionally, while the cutout or female key 126 is seen in FIGS. 15A and 16A as a hole or aperture defined through the front surface, it is to be expressly understood that the cutout or female key 126 may comprise an additional surface or contact point beyond what is provided by the edge or thickness of the front surface itself. For example, the cutout or female key 126 may comprise a hood, ridge, or other projection or extension which extends out in a perpendicular direction relative to the vertical orientated front surface so that a contact point or frictional surface is formed other than at the position or vertical plane shared by the front surface itself.

Figure 17A:
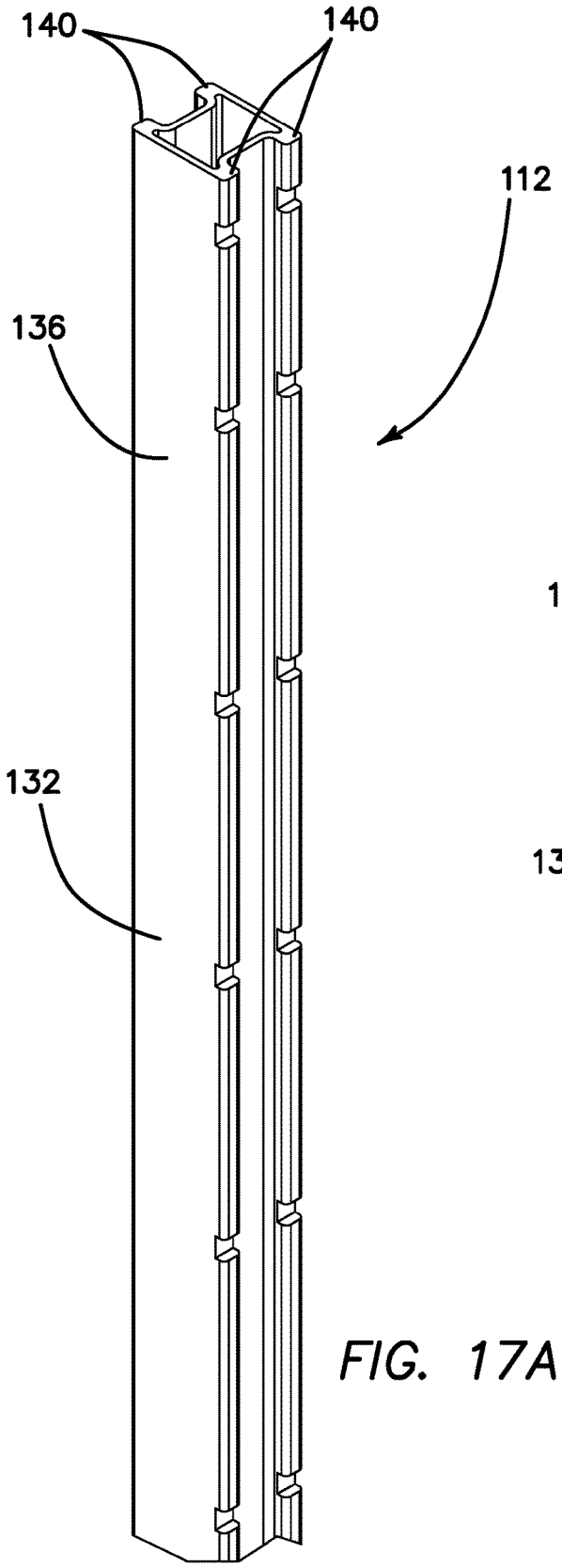
FIG. 17A is a magnified perspective view of an upright or post used within the alternative embodiment of the shelving system.
Figure 17B:
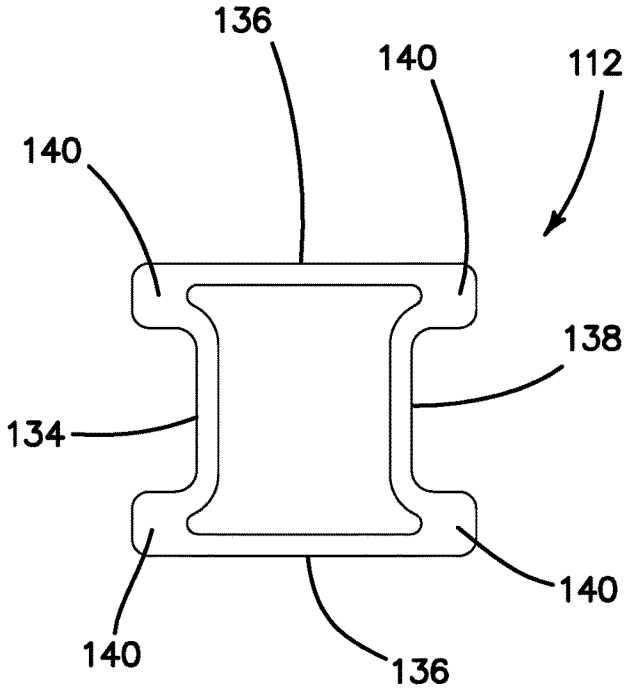
FIG. 17B is a cross sectional view of the upright or post seen in FIG. 17A.
Figure 17C:
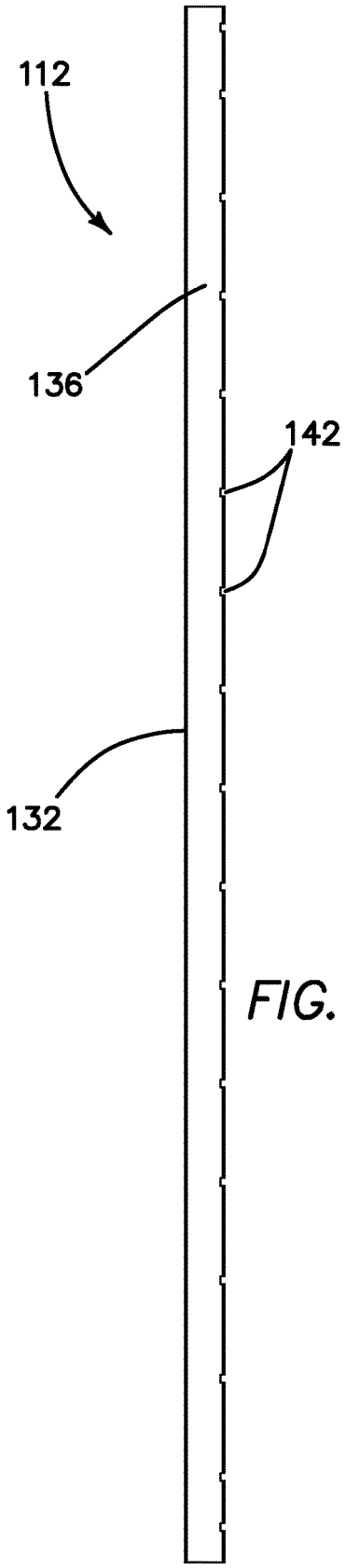
FIG. 17C is a plan view of a smooth or flat side of the upright or post seen in FIG. 17A.

Greater detail of the vertical uprights or posts 112 may be had by turning to FIGS. 17A-17E. As seen in FIGS. 17A and 17B, each vertical upright or post 112 comprises an elongated form or body 132 with a substantially square or rectangular cross section formed by four sides, namely two smooth or flat sides 136, a rear or outer side 134, and a notched or inner side 138 which comprises a plurality of coupling positions disposed along its corresponding height. As best seen in FIG. 17B, each of the smooth or flat sides 136 are disposed parallel to each other while the rear or outer side 134 and the notched or inner side 138 are in turn disposed parallel to each other, the parallel rear or outer side 134 and notched or inner side 138 being disposed orthogonal or perpendicular to the parallel pair of smooth or flat sides 136.

Figure 17D:
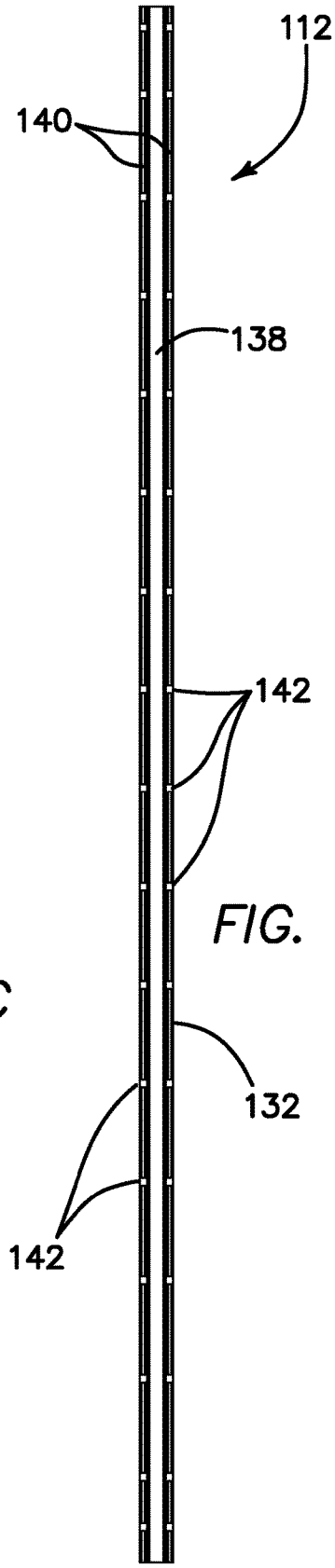
FIG. 17D is a plan view of a notched or inner side of the upright or post seen in FIG. 17A.
Figure 17E:
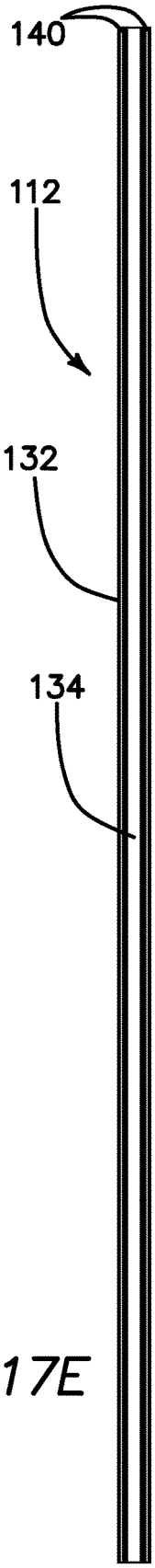
FIG. 17E is a plan view of a rear or outer side of the upright or post seen in FIG. 17A.

The notched or inner side 138 and the rear or outer side 134 of each vertical upright or post 12 may be seen in FIGS. 17D and 17E, respectively. In FIGS. 17D and 17E, it can be seen that both the notched or inner side 138 and the rear or outer side 134 of each vertical post 12 comprises a vertically orientated set of parallel rails or protrusions 140 which extend throughout the height of the form or body 132 of each upright or post 112. As seen in the top down view of FIG. 17B, each rail or protrusion 140 extends the cross sectional area or footprint of the upright or post 112 at each of its four corners so as to form a substantially double 'I' or 'H' beam shape. A plurality of gaps or notches 142 are defined throughout the height of each rail or protrusion 140 disposed on the notched or inner side 138 of each upright or post 112 while the rails or protrusions 140 disposed on the opposing smooth or flat side 136 are solid and continuous. In other words, the rails or protrusions 140 disposed on the notched or inner side 138 comprise a plurality of symmetrical gaps or notches 142 defined therein while the rails or protrusions 140 disposed on the smooth or flat side 136 provide a solid surface that remain gap or notch free throughout their entire respective heights. The gaps or notches 142 are defined in a symmetrical pattern through the heights of the rails or protrusions 140 disposed on the notched or inner side 138 with each gap or notch 142 forming a substantially lateral parallel pair of gaps or notches 142 disposed across the parallel rails or protrusions 140.

Figure 18A:
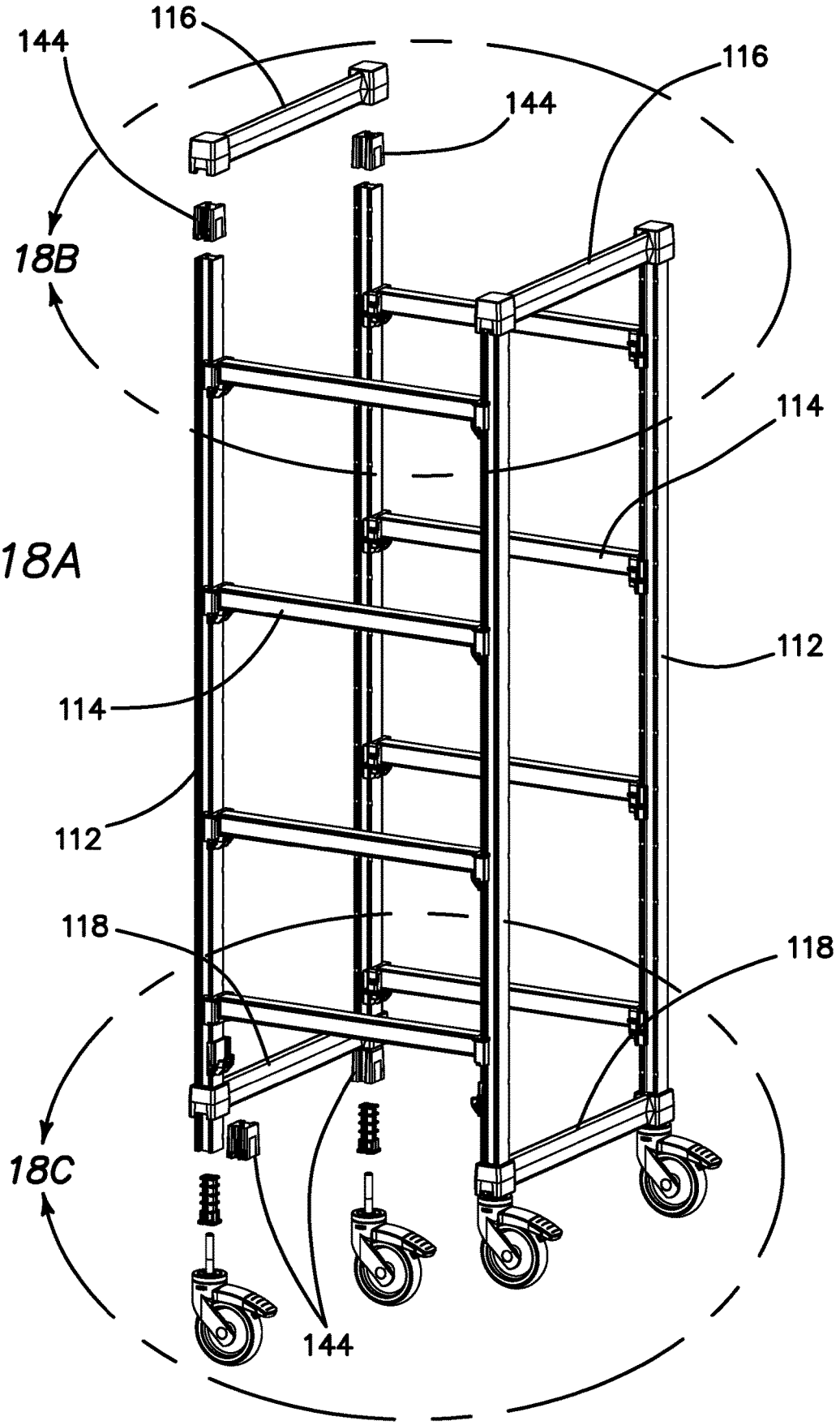
FIG. 18A is a partially exploded perspective view of the shelving system seen in FIG. 14.
Figure 18B:
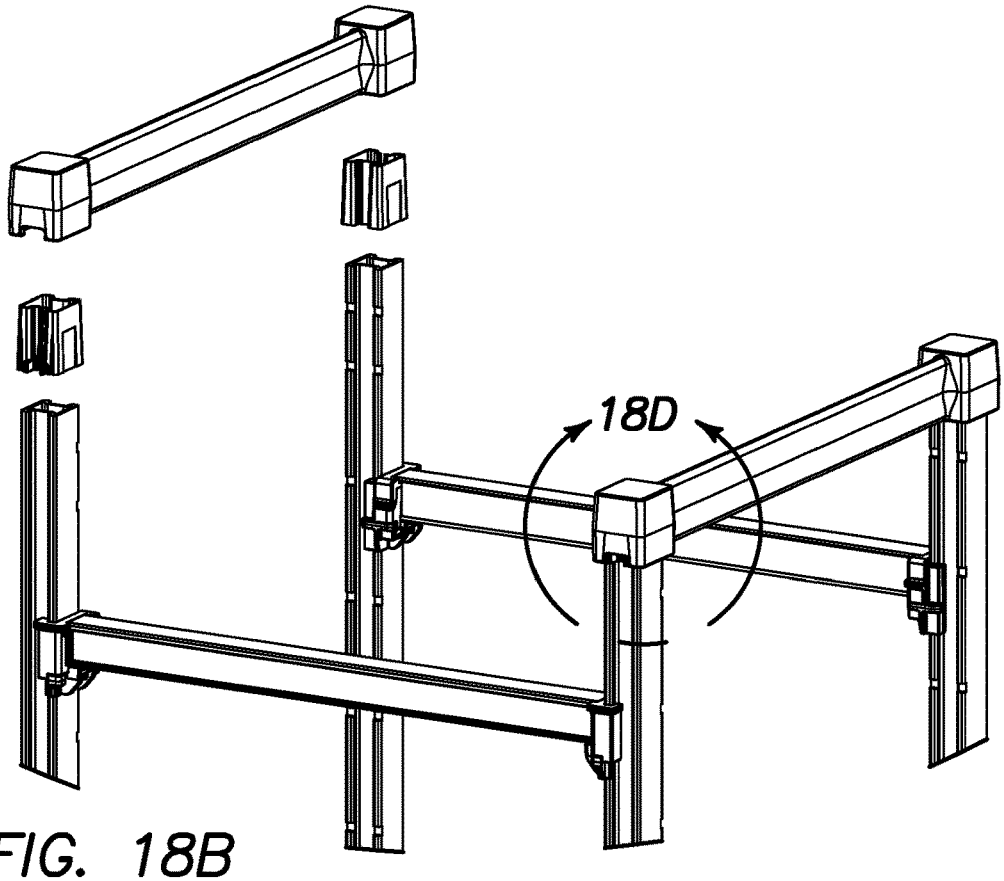
FIG. 18B is a magnified view of the top portion of the partially exploded perspective view of the shelving system seen in FIG. 18A.
Figure 18D:
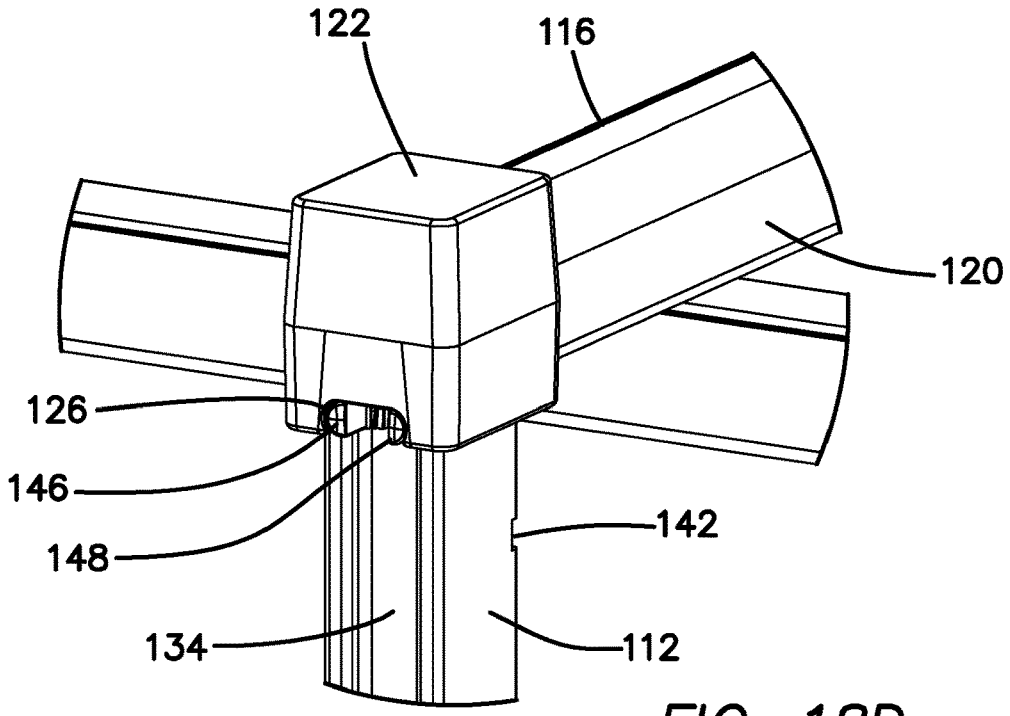
FIG. 18D is a magnified view of a coupling between a top or upper connector and an upright or post seen in FIG. 18A.
Figure 18C:
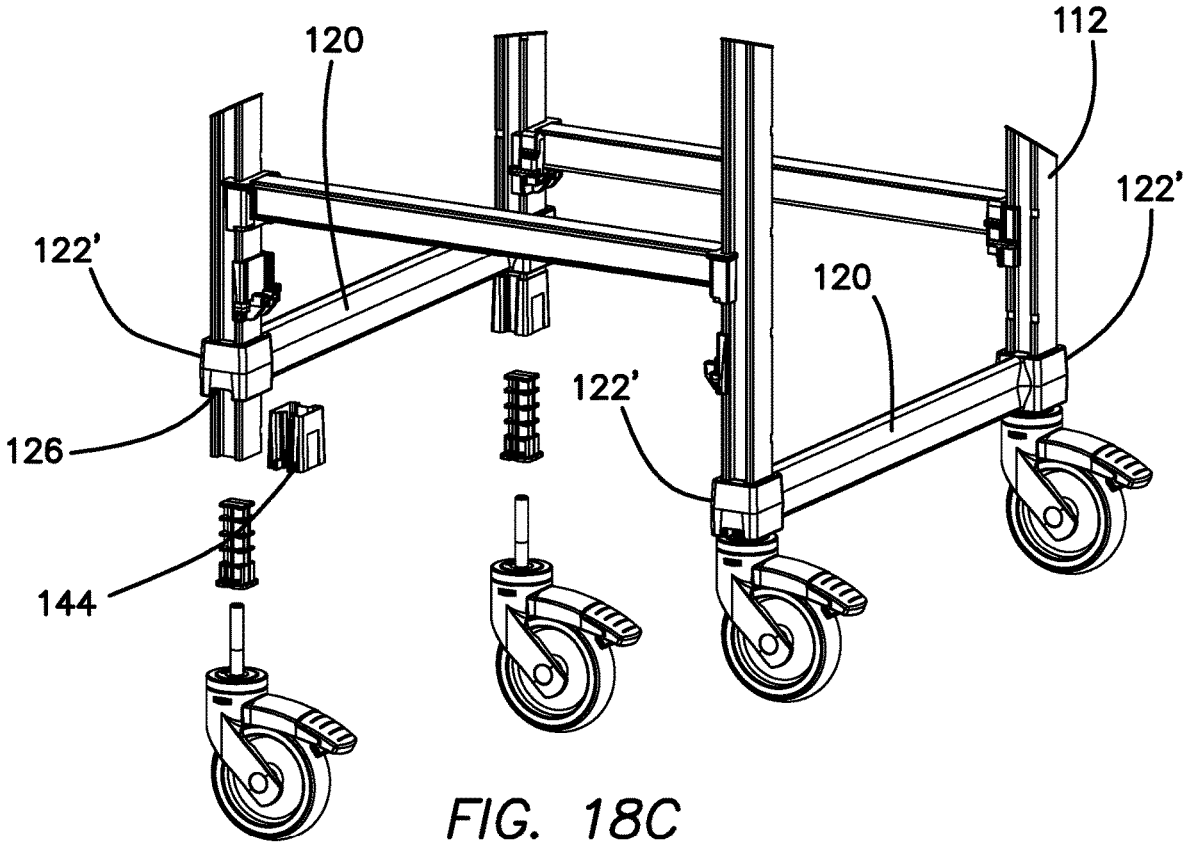
FIG. 18C is a magnified view of the bottom portion of the partially exploded perspective view of the shelving system seen in FIG. 18A.
Figure 19C:
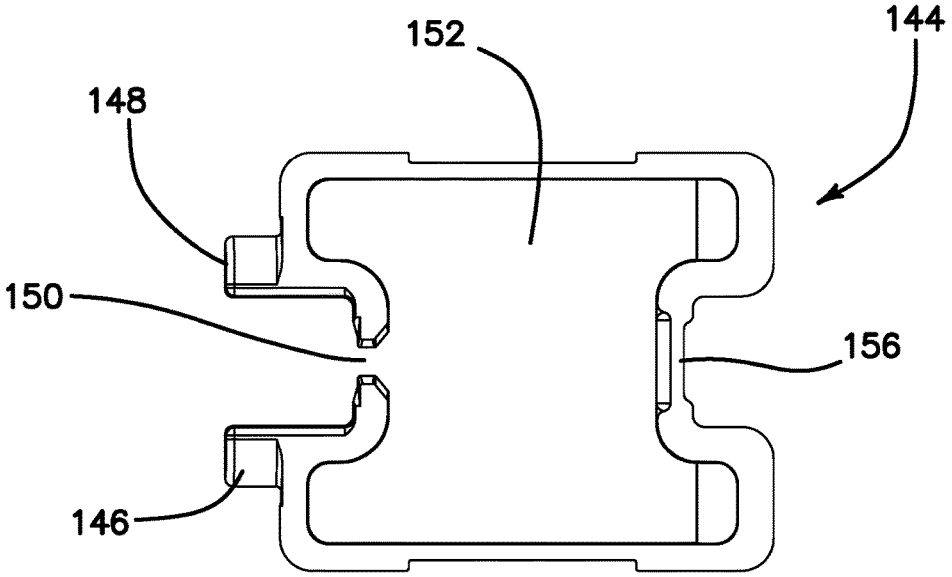
FIG. 19C is bottom plan view of the cap or sleeve insert seen in FIG. 19A.
Figure 19A:
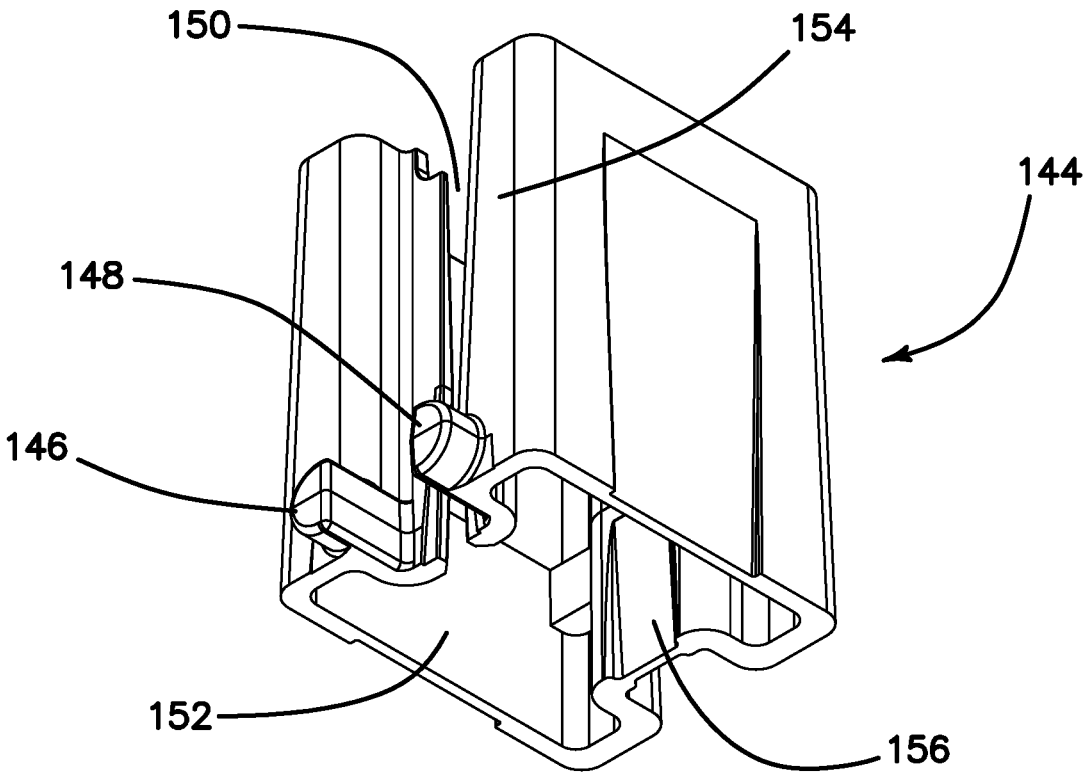
FIG. 19A is an upward perspective view of a cap or sleeve insert used to couple the connectors to the posts of the shelving system seen in FIG. 14.
Figure 19B:
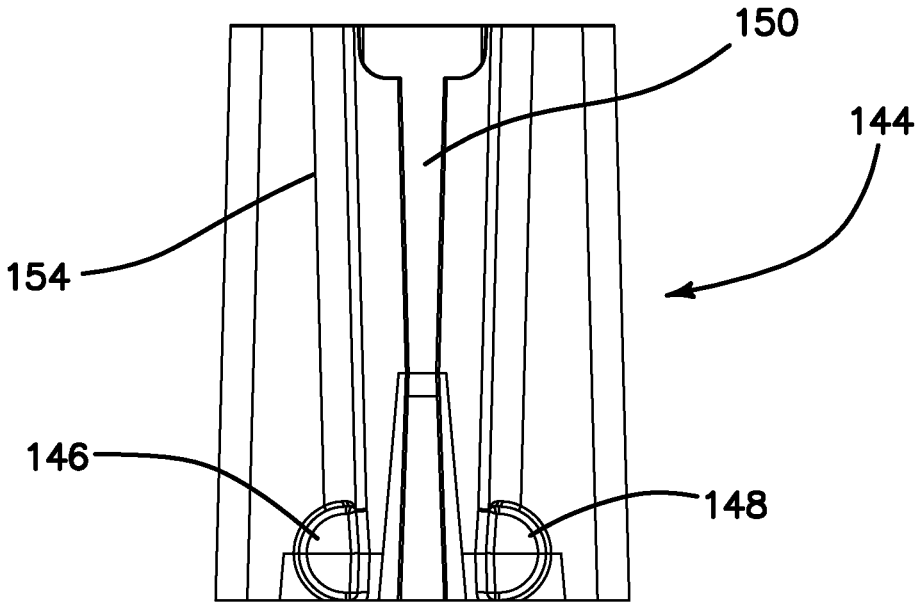
FIG. 19B is a frontal plan view of the cap or sleeve insert seen in FIG. 19A.

Turning to FIGS. 18A-18D and 19A-190, the frictional coupling or engagement between a top or upper connector 16 and a vertical upright or post 12 may be seen. First, a cap or sleeve insert 144 best seen in FIGS. 19A and 19B is coupled to the upright or post 112. The cap or sleeve insert 144 is composed of plastic or plastic composite and is substantially trapezoidal or tapered in shape, specifically with a smaller, narrower top portion and a larger, wider bottom portion. The back or rear wall 156 of the cap or sleeve insert 144 as best seen in FIG. 19C comprises a seam or is comprised of a slightly thinner surface relative to the remaining portions of the cap or sleeve insert 144 so as to increase the overall flexibility or bendability of the back or rear wall 156. The front or forward wall 154 of the cap or sleeve insert 144 comprises a recessed frontal opening or split 150 defined along the entire height of the cap or sleeve insert 144. As seen in FIGS. 19A-19C, the frontal opening or split 150 effectively divides or bifurcates the front or forward wall 154 into two substantially equal halves or parts. Also disposed on the front or forward wall 154 is a pair of mirror image catches or tabs, specifically a left catch or tab 146 and a right catch or tab 148. The left and right catches or tabs 146, 148 are substantially mirror image shaped in that the left catch or tab 146 comprises a left-orientated semi-hemispherical shape, while the right catch or tab 148 comprises a right-orientated semi-hemispherical shape, with the opposing flat edges or surfaces of each of the left and right catches or tabs 146, 148 facing one another. As best shown in FIG. 19A, the cap or sleeve insert 144 is substantially hollow with an internal volume or vacancy defined throughout its corresponding vertical height with an opening or aperture 152 defined at either end of the cap or sleeve insert 144. The cap or sleeve insert 144 is coupled to an upright or post 112 by bringing the cap or sleeve insert 144 into close proximity of the upright or post 112 with the front or forward wall 154 of the cap or sleeve insert 144 facing or orientated towards the notched or inner side 138 of the upright or post 112. The catches or tabs 146, 148 are then pulled apart or separated by pulling the catches or tabs 146, 148 away from each other, thereby increasing the size of the frontal opening or split 150 and simultaneously bending or folding the back or rear wall 156. The cap or sleeve insert 144 is then disposed around the circumference of the upright or post 112 with the form or body 132 of the upright or post 112 passing through the expanded frontal opening or split 150. The cap or sleeve insert 144 is then relaxed which in turn brings the left and right catches or tabs 146, 148 back together and closes the frontal opening or split 150 about the upright or post 112. Once coupled to the upright or post 112, the front or forward wall 154 of the cap or sleeve insert 144 is then disposed over and in front of the rear or outer side 134 of the upright or post 112.

Next, the top or upper connector 116 is disposed over the top of both the cap or sleeve insert 114 and the top portion of the upright or post 112, specifically with the opening or aperture 124 defined in the bottom surface of the end piece or cap 122 aligned or disposed directly over the cap or sleeve insert 144 coupled to the upright or post 112. The end piece or cap 122 is brought vertically downward over the top of the cap or sleeve insert 144 so that it enters or is inserted through the opening or aperture 124 and into the hollow interior volume of the end piece or cap 122. As the top or upper connector 116 is pushed downward, the left and right catches or tabs 146, 148 disposed on the cap or sleeve insert 144 are inserted or move into the cutout or female key 126 defined within the end piece or cap 122. The left and right catches or tabs 146, 148 are nested within the cutout or female key 126 so that the entirety of both semi-hemispherical surfaces of the left and right catches or tabs 146, 148 are in contact with a corresponding inner surface of the cutout or female key 126. At the same time the left and right catches or tabs 146, 148 are inserted into the cutout or female key 126, an internal surface of the end piece or cap 122 makes increasingly direct contact with the outside surfaces of the cap or sleeve insert 144 due to the substantially tapered shape of the cap or sleeve insert 144. In other words, the more the end piece or cap 122 is pushed downward over the cap or sleeve insert 144, the tighter or closer the coupling between the end piece or cap 122 and the cap or sleeve insert 144. After making contact with the cap or sleeve insert 144, all further downward movement of the end piece or cap 122 and thus the top or upper connector 116 as a whole relative to the upright or post 112 is prevented. Each end piece or cap 122 of the top or upper connector 116 may be coupled to an upright or post 112 individually, or multiple end pieces or caps 122 may be coupled to two different uprights or posts 112 simultaneously, thereby helping form one lateral side of the shelving system 100 as seen in FIG. 14A.

A similar procedure but in reverse sequence may be performed in order to couple a bottom or lower connector 118 to an upright or post 112 as seen in FIGS. 18A and 180. Specifically, a bottom or lower connector 118 is disposed over the bottom end or edge of an upright or post 112 by inserting or threading the bottom end of the upright or post 112 through the pair of openings or apertures 124' defined in the top and bottom surfaces of the collar or sleeve 122' disposed on the bottom or lower connector 118. The bottom or lower connector 118 is then brought upward relative to the upright or post 112 with the form or body 132 of the upright or post 112 passing through the hollow interior of the collar or sleeve 122'. The bottom or lower connector 118 is initially brought upwards past or beyond the vertical position which the user wishes to couple the bottom or lower connector 118 to the upright or post 112.

Next, a cap or sleeve insert 144 is then coupled to the upright or post 112 at the vertical position where the bottom or lower connector 118 is to be coupled by bringing the cap or sleeve insert 144 into close proximity of a lower or bottom portion of the upright or post 112 with the front or forward wall 154 of the cap or sleeve insert 144 initially facing or orientated towards the notched or inner side 138 of the upright or post 112. The catches or tabs 146, 148 are then pulled apart or separated by pulling the catches or tabs 146, 148 away from each other, thereby increasing the size of the frontal opening or split 150 and simultaneously bending or folding the back or rear wall 156. The cap or sleeve insert 144 is then disposed around the circumference of the upright or post 112 with the form or body 132 of the upright or post 112 passing through the expanded frontal opening or split 150. The cap or sleeve insert 144 is then relaxed which in turn brings the left and right catches or tabs 146, 148 back together and closes the frontal opening or split 150 about the upright or post 112. Once coupled to the upright or post 112, the front or forward wall 154 of the cap or sleeve insert 144 is then disposed over and in front of the rear or outer side 134 of the upright or post 112.

Once the cap or sleeve insert 144 is coupled at the desired position, the bottom or lower connector 118 is then disposed over the cap or sleeve insert 144. Specifically, the collar or sleeve 122' is brought vertically downward over the top of the cap or sleeve insert 144 so that it enters or is inserted through the opening or aperture 124' and into the hollow interior volume of the collar or sleeve 122'. As the bottom or lower connector 118 is pushed downward, the left and right catches or tabs 146, 148 disposed on the cap or sleeve insert 144 is inserted or moves into the cutout or female key 126 defined within the collar or sleeve 122'. The left and right catches or tabs 146, 148 are nested within the cutout or female key 126 so that the entirety of both semi-hemispherical surfaces of the left and right catches or tabs 146, 148 are in contact with a corresponding inner surface of the cutout or female key 126. At the same time the left and right catches or tabs 146, 148 are inserted into the cutout or female key 126, an internal surface of the collar or sleeve 122' makes increasingly direct contact with the outside surfaces of the cap or sleeve insert 144 due to the substantially tapered shape of the cap or sleeve insert 144. In other words, the more the collar or sleeve 122' is pushed downward over the cap or sleeve insert 144, the tighter or closer the coupling between the collar or sleeve 122' and the cap or sleeve insert 144. After making contact with the cap or sleeve insert 144, all further relative movement of the collar or sleeve 122' and thus the bottom or lower connector 118 as a whole relative to the upright or post 112 is prevented. Each collar or sleeve 122' of the top or upper connector 116 may be coupled to an upright or post 112 individually, or multiple collars or sleeves 122' may be coupled to two different uprights or posts 112 simultaneously, thereby helping form one lateral side of the shelving system 100 as seen in FIG. 14A. Like with the coupling between the top or upper connector 116 and a cap or sleeve insert 144 discussed above, the coupling between the bottom or lower connector 118 and a cap or sleeve insert 144 provides a means for resisting applied shear forces.

Figures 22A, 22B:
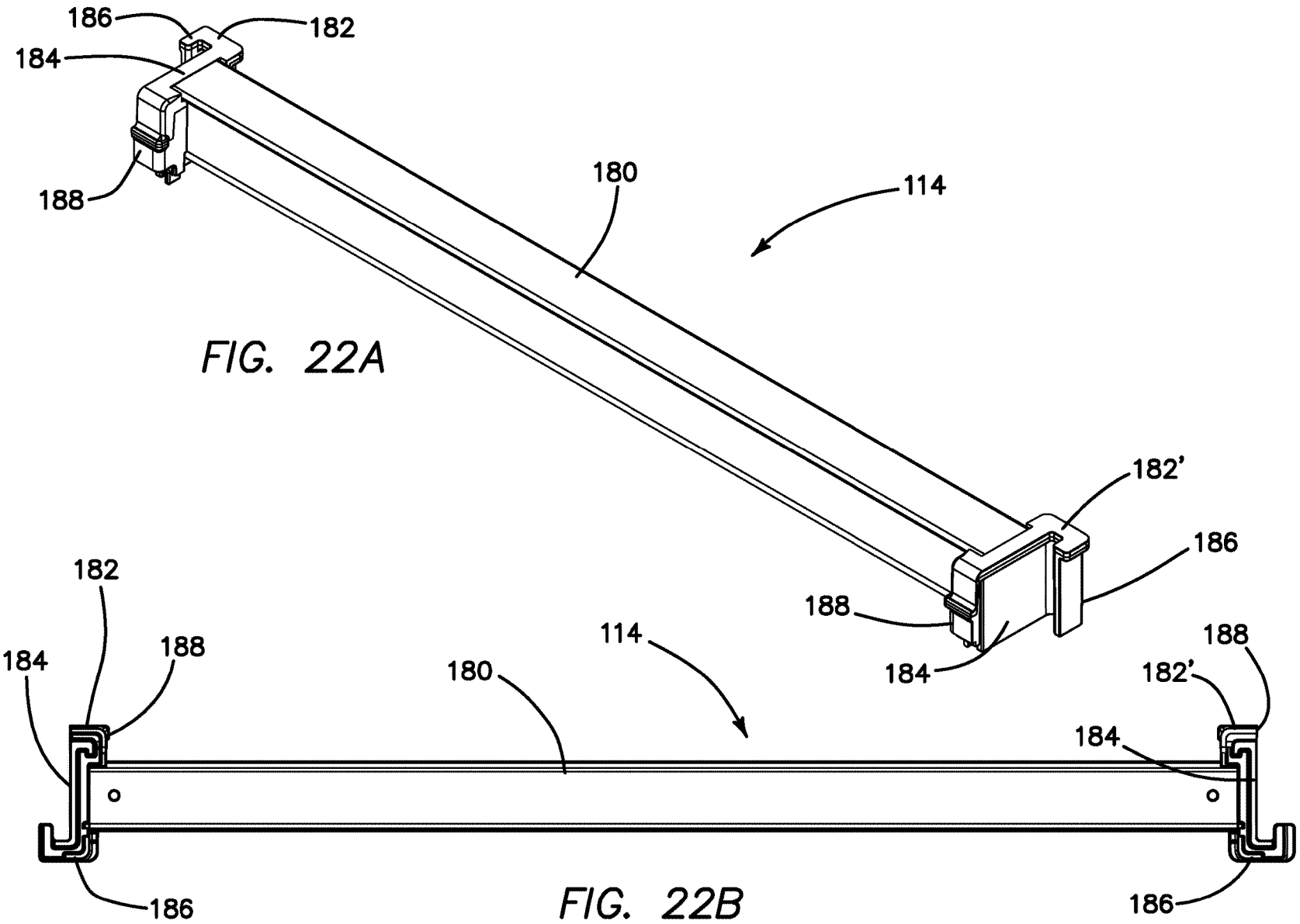
FIG. 22A is a perspective view of a shelf support or traverse used within the shelving system seen in FIG. 14.
FIG. 22B is a bottom plane view of the shelf support or traverse seen in FIG. 22A.

The shelf supports or traverses 114 are coupled to the vertical uprights or posts 12 by means of a plurality of removable fixtures or female brackets 160, 160' shown in greater detail in FIGS. 20A-21E, and a corresponding plurality of matching traverse coupling portions or male brackets 162, shown in greater detail in FIGS. 22A and 22B.

Figure 20A:
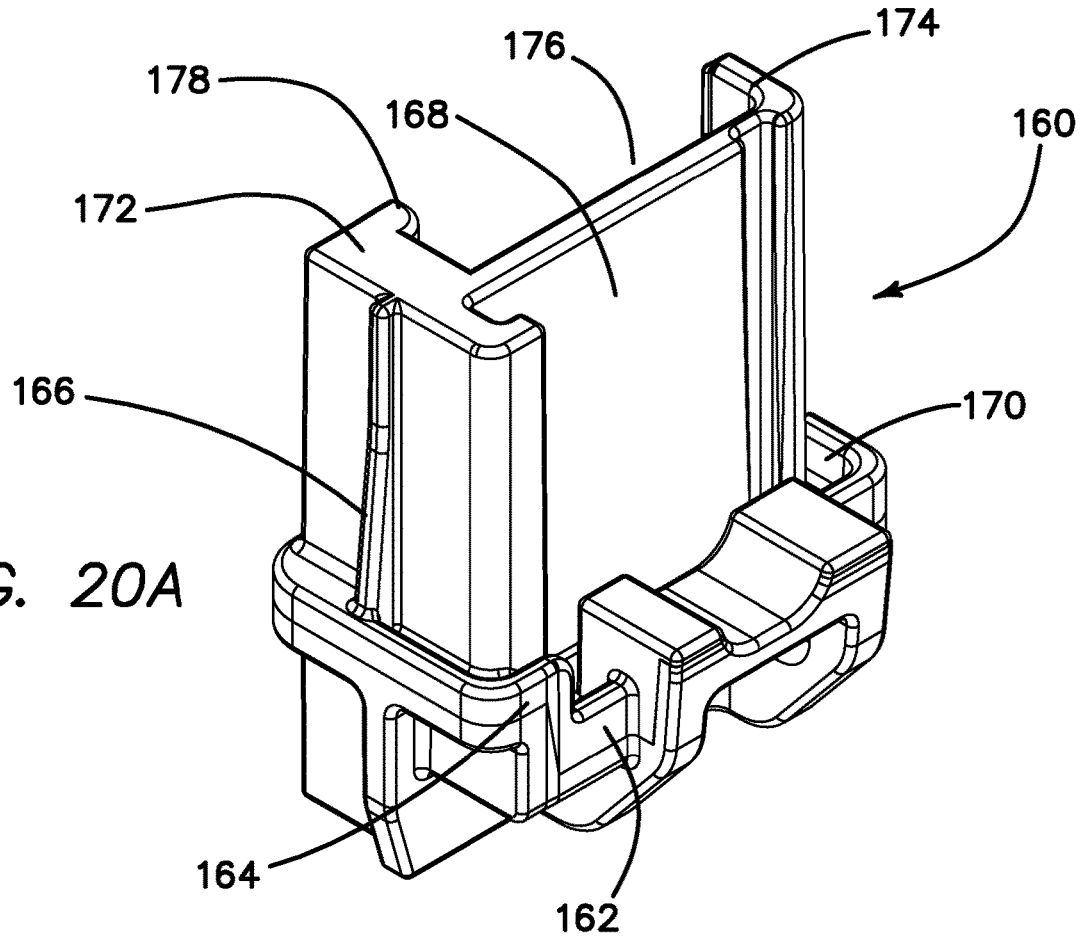
FIG. 20A is a perspective view of a left orientated fixture or female bracket used to couple a traverse to a post of the shelving system seen in FIG. 14.
Figure 20B:
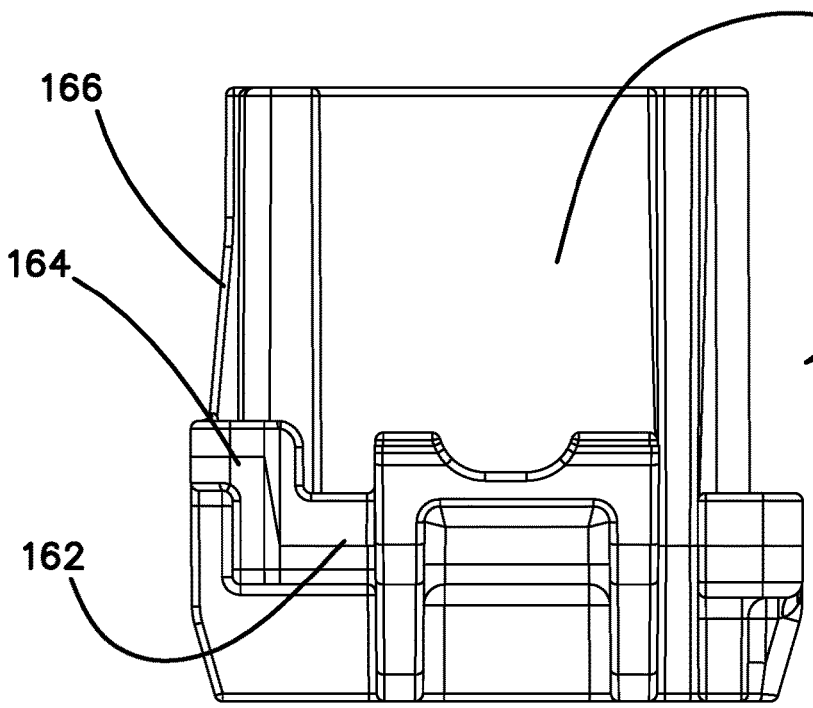
FIG. 20B is a frontal plan view of the left orientated fixture or female bracket seen in FIG. 20A.
Figure 20C:
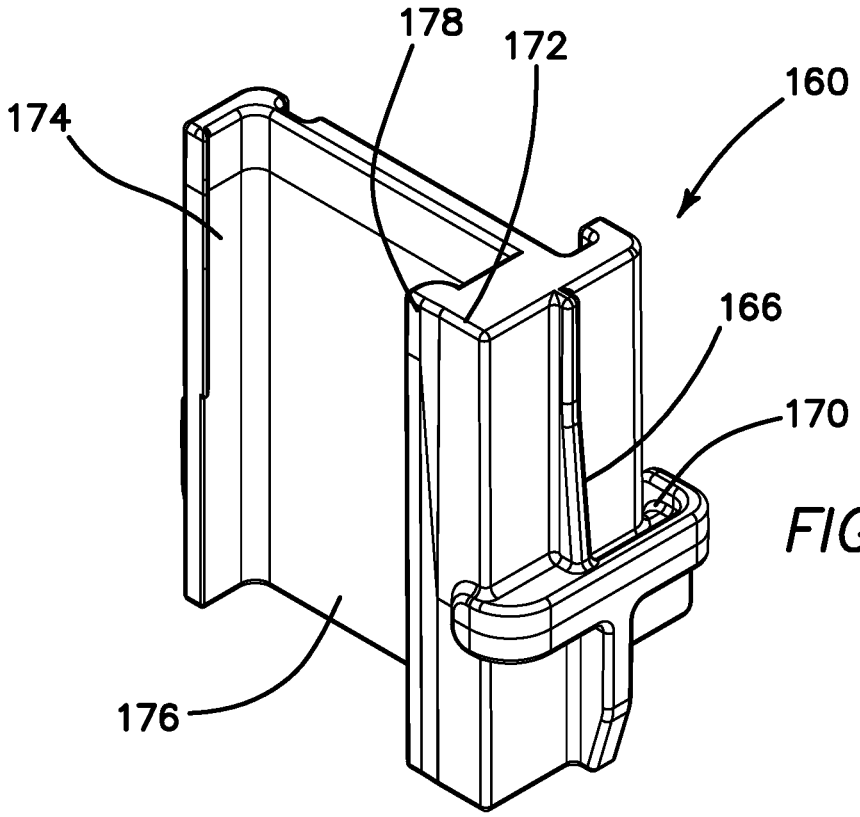
FIG. 20C is a left rear perspective view of the left orientated fixture or female bracket seen in FIG. 20A.
Figure 20D:
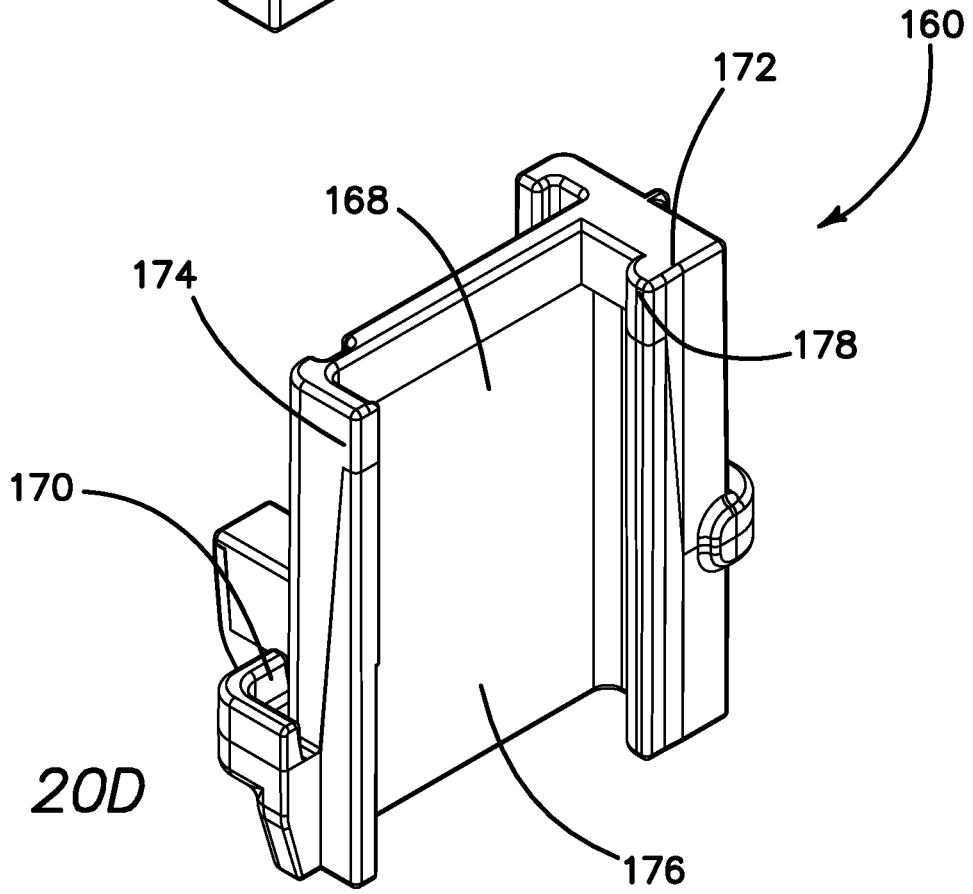
FIG. 20D is a right rear perspective view of the left orientated fixture or female bracket seen in FIG. 20A.
Figure 21A:
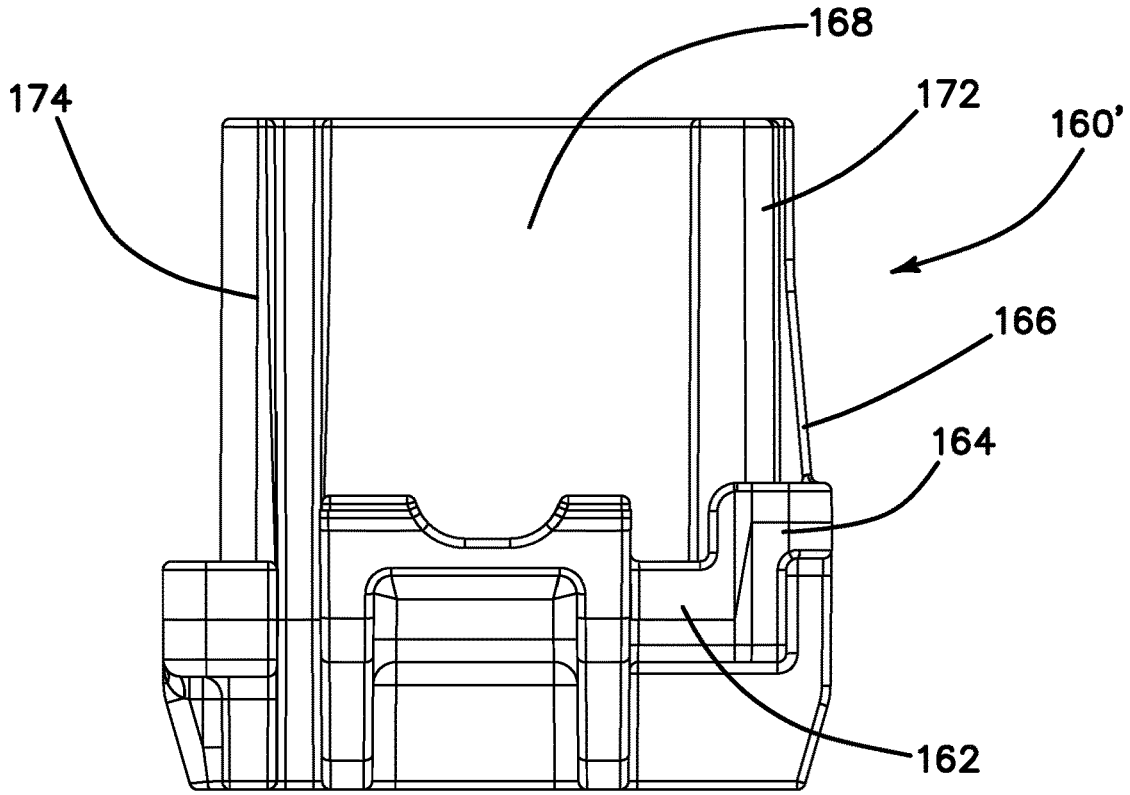
FIG. 21A is a frontal plan view a right orientated fixture or female bracket used to couple a traverse to a post of the shelving system seen in FIG. 14.
Figure 21B:
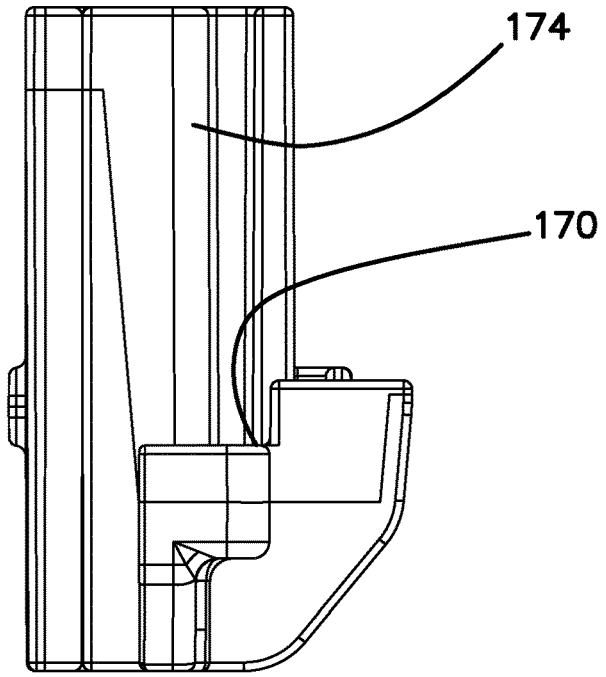
FIG. 21B is a left plan view of the right orientated fixture or female bracket seen in FIG. 21A.
Figure 21C:
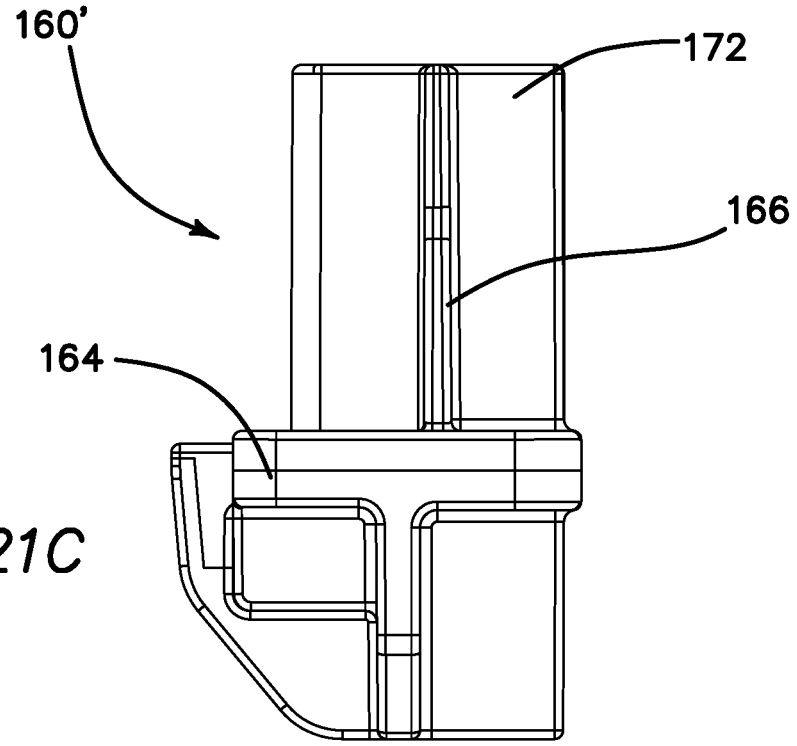
FIG. 21C is a right plan view of the right orientated fixture or female bracket seen in FIG. 21A.
Figure 21D:
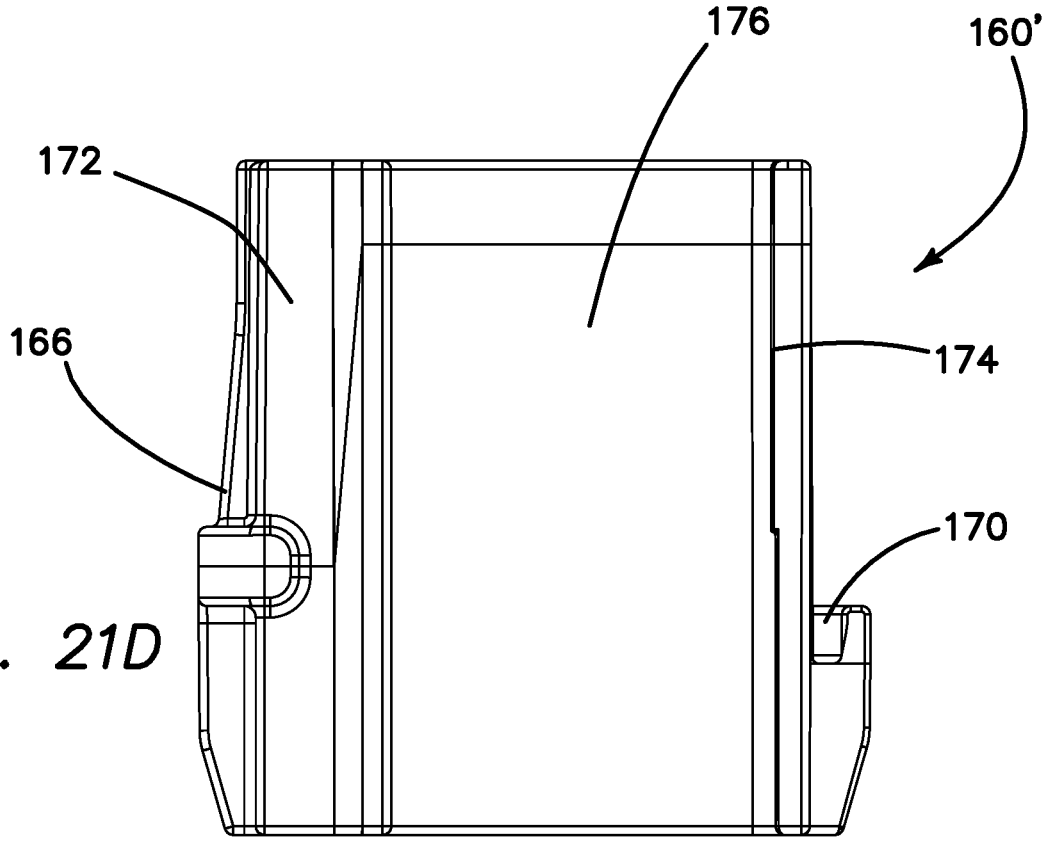
FIG. 21D is a rear plan view of the right orientated fixture or female bracket seen in FIG. 21A.
Figure 21E:
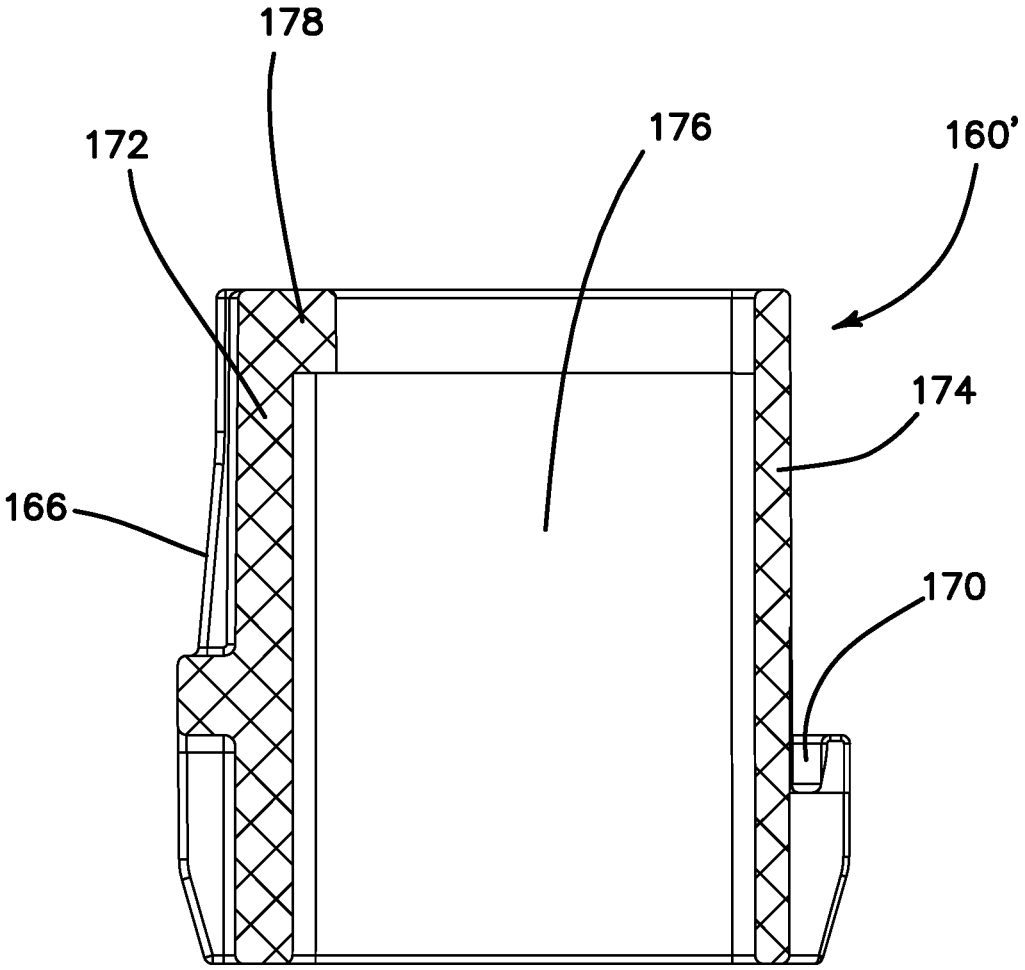
FIG. 21E is a rear cross-sectional view of the right orientated fixture or female bracket seen in FIG. 21D.

The plurality of fixtures or female brackets comprise either a left configuration or orientation 160 seen in FIGS. 20A-20D, or a right configuration or orientation shown 160' in FIGS. 21A-21E. Each left and right configuration of the fixtures or female brackets 160, 160' comprises a seat or base 162 disposed on a lower part of a vertical portion or wall 168. The seat or base 162 comprises a raised portion or corner 164 disposed on a corresponding side, namely with the raised portion or corner 164 disposed on the left facing side of the seat or base 162 of the left orientated fixture or female bracket 160 seen in FIG. 20B, while the raised portion or corner 164 is disposed on the right facing side of the seat or base 162 of the right orientated fixture or female bracket 160' seen in FIG. 21A. Defined between the seat or base 162 and the vertical portion or wall 168 of each left and right orientated fixture or female bracket 160, 160' is a trough or pocket 170. As best seen in FIG. 20A, the trough or pocket 170 is a void or negative space defined around three sides of the vertical portion or wall 168, namely the left facing side, the front facing side, and the right facing side. Each left and right orientated fixture or female bracket 160, 160' also comprises a substantially tapered or dove tailed male component or edge 166 that is disposed on the left or right facing side of the fixtures or female brackets 160, 160', respectively. Each male component or edge 166 is substantially tapered or dove tailed shape along its height, specifically with a relatively narrow or thin width at a top portion of the male component or edge 166 which gradually widens along its height until making contact with the seat or base 162. The widest or thickest portion of the male component or edge 166 is coupled or formed into the bottom surface of the trough or pocket 170. Both the left and right orientated fixtures or female brackets 160, 160' are comprised of injected molded plastic.

Turning now to the back or rear side of the left and right orientated fixtures or female brackets 160, 160' as seen in FIGS. 20C-20D and FIGS. 21D-21E, respectively, it can be seen that both fixtures or female brackets 160, 160' comprise a substantially "L" shaped hook or rail connector 172 when viewed from above. The hook or rail connector 172 of the left orientated fixture or female bracket 160 is disposed on the left facing side, while the hook or rail connector 172 of the right orientated fixture or female bracket 160' is disposed on the right facing side. Disposed on the side or edge opposing the hook or rail connector 172 of each fixture or female bracket 160, 160' is an extended edge or brace 174. The hook or rail connector 172, the extended edge or brace 174, and the rear surface of the vertical portion or wall 168 cooperate to form a substantially rectangular shaped space or post aperture 176 on three sides with an open face or side free to accommodate the width of an upright or post 112 as detailed further below.

Each hook or rail connector 172 is bent around on itself behind the vertical portion or wall 168 so as to form a substantial "L" shape when viewed from above. Each hook or rail connector 172 is further disposed on the backside of each left and right orientated fixtures or female brackets 160, 160' throughout its entire height. Disposed within an inside or inner surface of each hook or rail connector 172 is a peg or tab 178 as best seen in the cross sectional view of FIG. 21E. The peg or tab 178 is preferably disposed in the top portion or at a top edge of the hook or rail connector 172, specifically at or near the very top edge of the fixture or female bracket 160, 160' itself.

Turning to the shelf supports or traverses 114 seen in FIGS. 22A and 22B, each shelf support or traverse 114 comprises a substantially rectangular or parallelepiped shaped form or body 180 which is comprised of pultruded plastic or plastic composites. Disposed or coupled to either lateral end of the form or body 180 is a male bracket or traverse end piece, specifically either a left orientated or configured male bracket or traverse end piece 182, or a right orientated or configured male bracket or traverse end piece 182'. Each male bracket or traverse end piece 182, 182' may be coupled to a shelf support or traverse 114 or alternatively, may be integrally formed with the shelf support or traverse 114 to form one solid component. Each male bracket or traverse end piece 182, 182' comprises a substantially flat or vertical front surface or face 184 disposed between a curve or smooth rail connector 186 and an engagement portion or bracket aperture 188. The left orientated male coupling or traverse end piece 182 is defined by the curve or smooth rail connector 186 being disposed on the left hand side of the male coupling or traverse end piece 182 and the engagement portion or bracket aperture 188 being disposed on the right hand side of the male coupling or traverse end piece 182 when viewed from the front. Conversely, the right orientated male coupling or traverse end piece 182' is defined by the curve or smooth rail connector 186 being disposed on the right hand side of the male coupling or traverse end piece 182' and the engagement portion or bracket aperture 188 being disposed on the left hand side of the male coupling or traverse end piece 182 when viewing the front surface or face 184 from a frontal planar view.

In order to couple a shelf support or traverse 114 to a vertical upright or post 112, a user first brings a fixture or female bracket 160 in proximity to an upright or post 112 and places the notched or inner side 138 of the upright or post 112 into the space or post aperture 176, specifically with one of the rails or protrusions 140 disposed on the notched or inner side 138 nested or fitted within the negative space created by the hook or rail connector 172. The user then inserts the peg or tab 178 disposed on the hook or rail connector 172 into one of the plurality of gaps or notches 142 at the position or height the user wishes to couple the shelf support or traverse 114 to the upright or post 112.

Next, the user then slides a male coupling or traverse end piece 182, 182' down onto a corresponding fixture or female bracket 160, 162', specifically with a left orientated male coupling or traverse end piece 182 being slid down on a right orientated fixture or female bracket 160', and a right orientated male coupling or traverse end piece 182' being slid down on a left orientated fixture or female bracket 160. In other words, each male coupling or traverse end piece 182, 182' is coupled to a fixture or female bracket 160, 160' comprising an opposing orientation relative to its self. The front surface or face 184 of the male coupling or traverse end piece 182, 182' first makes contact with the vertical portion or wall 168 of the fixture or female bracket 160, 160' so that as the male coupling or traverse end piece 182, 182' is being slid over the fixture or female bracket 160, 160', the engagement portion or bracket aperture 188 is inserted over the substantially dove-tailed shaped tapered surface or edge 166 while the curve, or smooth rail connector 186 simultaneously accommodates both the extended edge or brace 174 and the rail or protrusion 140 disposed on the rear or outer side 134 of the upright or post 112, thereby joining the shelf support or traverse 114 to the vertical upright or post 112.

Due to the substantially dove-tailed shape of the tapered surface or edge 166 of the male coupling or traverse end piece 182, 182', the further the engagement portion or bracket aperture 188 is slid distally downward over the tapered surface or edge 166, the more force that is created and directed toward the center of the vertical upright or post 112. In other words, because the tapered surface or edge 166 comprises a dove-tailed width along its height, as the male coupling or traverse end piece 182, 182' and the fixture or female bracket 160, 160' are brought together, a static force is created which pushes the fixture or female bracket 160, 160' into the vertical upright or post 112. As more weight is added to the shelf support or traverse 114, either directly or indirectly through a shelf or shelf-plate disposed on the upright or traverse 114, the larger the static force becomes which in turn further pushes the fixture or female bracket 160, 160' into the vertical upright or post 112. The upright or post 112 in turn responds with a reactionary force that pushes the fixture or female bracket 160, 160' in the opposite direction to that of the inward force created by the load placed on the shelf support or traverse 114, thus maintaining static equilibrium between the shelf support or traverse 114 and the upright or post 112. The combination of the force distribution scheme provided by the dove-tailed shaped tapered surface or edge 166 with the strength provided by the shelf supports or traverses 114 and uprights or posts 112 fabricated by pultrusion allows for large load amounts to be placed on the shelf supports or traverses 114 and thus by extension, on the entire shelving system 100 as a whole without the fear of structural failure.

Figure 14:
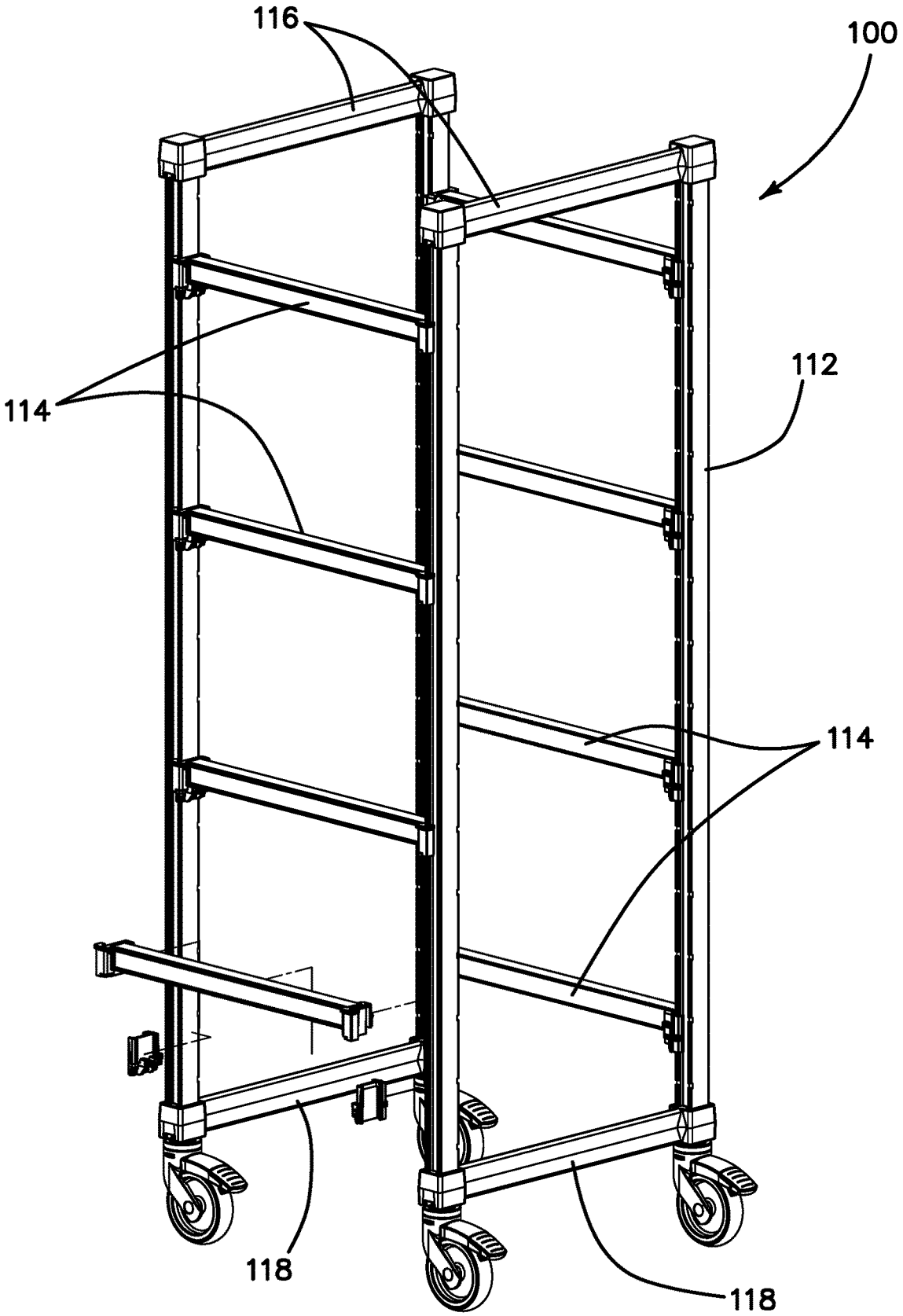
FIG. 14 is a perspective view of an alternative embodiment of the shelving system comprising an alternative means for coupling the plurality of traverses and top and bottom connectors to the plurality of vertical posts.
Figure 23A:
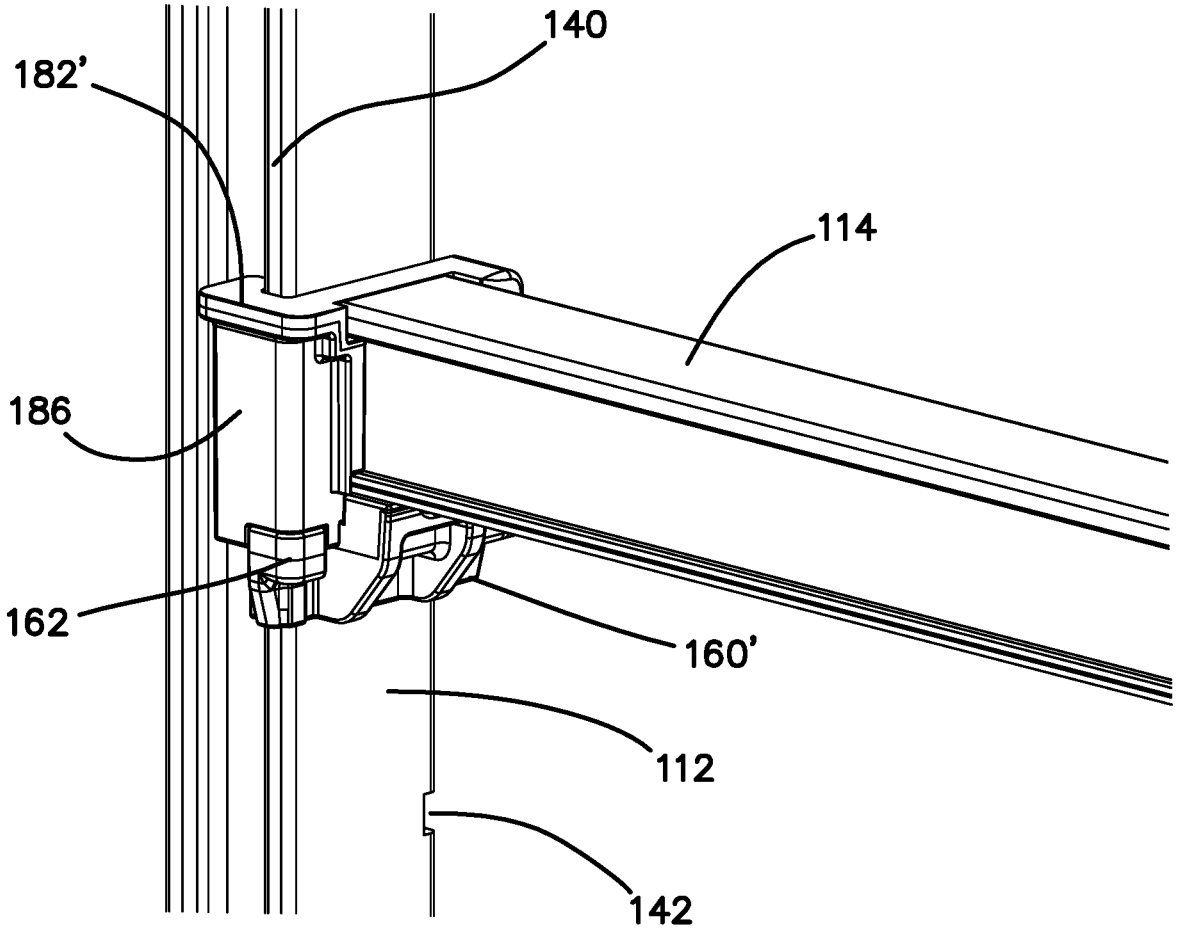
FIG. 23A is a magnified perspective view from the outside of the shelving system of the coupling between a traverse and a right orientated fixture or female bracket.
Figure 23B:
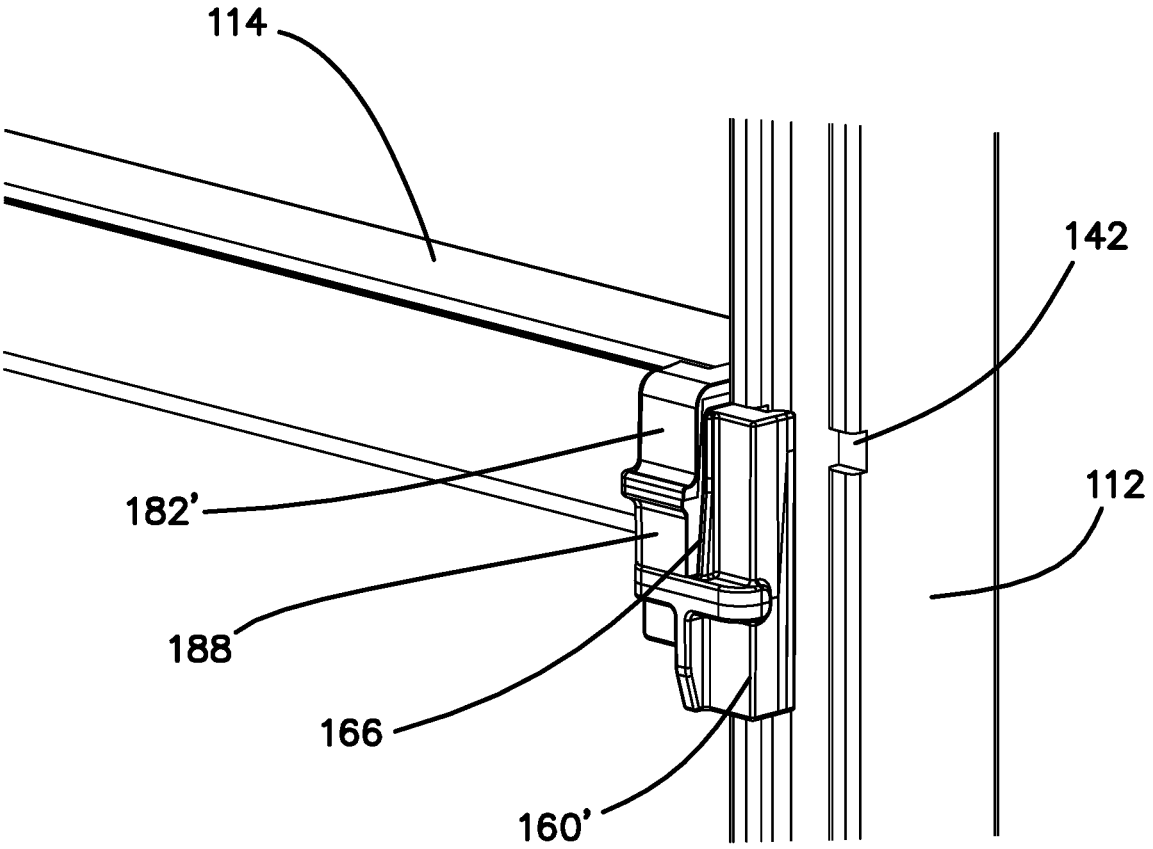
FIG. 23B is a magnified perspective view from the inside of the shelving system of the coupling between a traverse and a right orientated fixture or female bracket.

The male coupling or traverse end piece 182, 182' continues to be slid down the fixture or female bracket 160, 160' until a bottom portion of male coupling or traverse end piece 182, 182' makes contact with and then is inserted into the trough or pocket 170 so as to form a tightly fitted or nested configuration as seen in FIGS. 23A and 23B. Once the engagement portion or bracket aperture 188 of the male coupling or traverse end piece 182, 182' is fully slid down about the tapered surface or edge 166, a maximum force is created that squeezes the fixture or female bracket 160, 160' tightly to the vertical upright or post 112 and thus eliminates any need for any further coupling means. The same coupling process described above is then repeated for the opposing end of the shelf support or traverse 114 thus leaving the shelf support or traverse 114 firmly in place laterally between two uprights or posts 112 on either side of the shelving system 100 as seen in FIGS. 14 and 18A-180.

To remove or decouple a shelf support or traverse 114 from an upright or post 112, the user pushes up on the shelf support or traverse 114 and the male coupling or traverse end piece 182, 182'. In doing so, the engagement portion or bracket aperture 188 moves vertically up the tapered surface or edge 166 on which it is disposed, thereby decreasing the amount of force applied to the vertical upright or post 112 by the fixture or female bracket 160, 160' along the way. Once the male coupling or traverse end piece 182, 182' is clear of the corresponding fixture or female bracket 160, 160', the user is then free to remove the fixture or female bracket 160, 160' from the vertical upright or post 112 by removing the peg or tab 178 from the gap or notch 142 it is disposed in.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. A shelving system comprising:

a plurality of posts;

a plurality of connectors, each one of the plurality of connectors configured to couple to at least two of the plurality of posts;

a plurality of inserts;

a plurality of traverses, each one of the plurality of traverses configured to couple to at least two of the plurality of posts; and a plurality of removable female brackets, wherein each of the plurality of traverses comprises a male bracket disposed on each of a pair of ends of the traverse, wherein each of the plurality of removable female brackets comprises at least one tapered edge, wherein the male bracket disposed on each end of each of the plurality of traverses is configured to apply a force to at least one female bracket that is supportive of a weight applied to the shelving system, wherein each of the plurality of inserts comprises a pair of semi-hemispherical shaped catches, and wherein each of the plurality of connectors comprises a female key defined in a bottom edge of the connector, the female key comprising a pair of rounded surfaces that are configured to accommodate the semi-hemispherical shape of at least one of the pair of catches.

2. The shelving system of claim 1 wherein each the plurality of male brackets is configured to frictionally engage with the at least one tapered edge of a corresponding female bracket.

3. The shelving system of claim 1 wherein each of the plurality of removable female brackets comprises a tab configured to be inserted into at least one of a plurality of notches defined along a height of each of the plurality of posts.

4. The shelving system of claim 1 wherein each of the plurality of female brackets comprises a base with a pocket defined therein, wherein the pocket is configured to accommodate a corresponding one of the plurality of male brackets.

5. The shelving system of claim 1 wherein each of the plurality of inserts further comprises:

a hollow interior configured to accommodate one of the plurality of posts therethrough; and a front wall comprising a frontal opening which bifurcates the front wall into two equal halves, wherein at least one of the pair of catches is disposed on one of the two halves of the bifurcated front wall.

6. The shelving system of claim 1 wherein the pair of catches disposed on each of the plurality of inserts is configured to apply a reaction force in any direction to at least one of the plurality of connectors in response to a shear force applied to the shelving system.

7. The shelving system of claim 6 wherein the pair of catches disposed on each of the plurality of inserts is configured to apply the reaction force to the pair of rounded surfaces of the female key when the pair of catches are inserted into the female key.

8. The shelving system of claim 1 wherein the male bracket disposed on each end of each of the plurality traverses comprises a hook configured to accommodate a portion of at least one of the plurality of posts therein.

9. The shelving system of claim 5 wherein the hollow interior of each of the plurality of inserts comprises an internal volume which accommodates a horizontal cross sectional shape of a corresponding one of the plurality of posts.

10. A system for forming a shelf unit comprising:

a plurality of posts;

a plurality of removable top connectors, each of the plurality of top connectors comprising at least two end caps;

a plurality of removable bottom connectors, each of the plurality of bottom connectors comprising at least two collars;

a plurality of traverses, each of the plurality of traverses comprising at least two male brackets, a plurality of removable inserts each configured to couple either one of the plurality of top connectors or one of the plurality of bottom connectors to one of the plurality of posts; and a plurality of removable female brackets each configured to couple one of the plurality of traverses to one of the plurality of posts;

wherein each of the plurality of inserts comprise a pair of semi-hemispherical shaped catches which are configured to apply a reaction force in any direction to a corresponding pair of rounded surfaces that are configured to accommodate the semi-hemispherical shape of the pair of catches in response to a shear force applied to the shelf unit, the corresponding pair of rounded surfaces being within a female key that is defined in a bottom edge of at least one of the plurality of top connectors and at least one of the plurality of bottom connectors, and wherein the at least two male brackets disposed on each of the plurality of traverses is configured to apply a force to a corresponding one of the plurality female brackets that is supportive of a weight applied to the shelving system.

11. The system of claim 10 wherein the female key defined in the bottom edge of at least one of the plurality of top connectors and at least one of the plurality of bottom connectors is defined within the bottom edge of each of the end caps and each of the collars disposed on each of the plurality of top connectors and each of the plurality of bottom connectors, respectively.

12. The system of claim 10 wherein each of the plurality of female brackets comprises at least one tapered edge configured to interact with one of the at least two male brackets disposed on each of the plurality of traverses.

13. The system of claim 10 wherein each of the plurality of female brackets comprises a tab configured to be inserted into one of a plurality of notches defined along a first edge of at least one of the plurality of posts.

14. The system of claim 13 wherein each of the male brackets comprise a hook configured to accommodate a second edge of at least one of the plurality of posts, where the second edge of the at least one post is disposed on an opposing side of the at least one post relative to the first edge of the at least one post.

* * * * *